US006218064B1

(12) United States Patent
Ueda et al.

(10) Patent No.: US 6,218,064 B1
(45) Date of Patent: Apr. 17, 2001

(54) ELECTROPHOTOGRAPHIC APPARATUS AND ELECTROPHOTOGRAPHIC LIGHT RECEIVING MEMBER

(75) Inventors: Shigenori Ueda, Mishima; Junichiro Hashizume, Numazu; Ryuji Okamura, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/449,678

(22) Filed: Nov. 24, 1999

(30) Foreign Application Priority Data

Nov. 27, 1998 (JP) ..... 10-337938
Nov. 27, 1998 (JP) ..... 10-337942

(51) Int. Cl.[7] ..... G03G 5/147
(52) U.S. Cl. ..... 430/66; 430/67
(58) Field of Search ..... 430/58.1, 66, 67; 399/159

(56) References Cited

U.S. PATENT DOCUMENTS 4,675,265 * 6/1987 Kazama et al. ..... 430/66
4,965,156 * 10/1990 Hotomi et al. ..... 430/66
5,656,406 * 8/1997 Ikuno et al. ..... 430/67
5,900,342 * 5/1999 Visser et al. ..... 430/67
6,001,521 * 12/1999 Hashizume et al. ..... 430/58.1

FOREIGN PATENT DOCUMENTS 42-23910 11/1967 (JP) .
43-24748 10/1968 (JP) .
54-043037 4/1979 (JP) .
54-143149 11/1979 (JP) .
57-124777 8/1982 (JP) .
58-144865 8/1983 (JP) .
60-007451 1/1985 (JP) .
60-012554 1/1985 (JP) .
2-111962 4/1990 (JP) .

* cited by examiner

*Primary Examiner*—Roland Martin
(74) *Attorney, Agent, or Firm*—Fitzpatrick, Cella, Harper & Scinto

(57) ABSTRACT

In an electrophotographic apparatus having a structure for scrape-cleaning a developer of an average particle diameter of 5 to 8 $\mu$m with an elastic rubber blade having a modulus of repulsion elasticity of not less than 10% nor more than 50%, by using a light receiving member having a surface layer comprised of a non-monocrystalline fluorinated carbon film in which the wear loss after copying steps of 10,000 A4-size transfer sheets is not less than 0.1 Å nor more than 100 Å, in which the dynamic hardness is within the range of 10 to 500 kgf/mm$^2$, and in which the fluorine content is not less than 5 atomic % nor more than 50 atomic %, an electrophotographic apparatus is provided which can prevent scattering or fusion of a developer, uneven scraping of a surface layer and image smearing irrespective of the service environment conditions and also can prevent image smearing without provision of means for directly heating the light receiving member.

34 Claims, 5 Drawing Sheets

ELECTROPHOTOGRAPHIC APPARATUS AND ELECTROPHOTOGRAPHIC LIGHT RECEIVING MEMBER

BACKGROUND OF THE INVENTION

1. Field of the Invention

The present invention relates to an electrophotographic apparatus, and more particularly to an electrophotographic apparatus with an improved light receiving member.

2. Related Background Art

There have been known many electrophotographic methods, for example, as described in U.S. Pat. No. 2,297,692, Japanese Patent Publication No. 42-23910, and Japanese Patent Publication No. 43-24748. It is common practice to utilize a light receiving member, form an electric latent image on the light receiving member by various means, then develop the latent image with a developing agent (developer), electrically transfer the developer image onto a transfer medium such as paper as occasion demands, and thereafter fix the image by heat, pressure, heat and pressure, or solvent vapor or the like to obtain a copy.

In the above steps, since the residual developer remains on the surface of the light receiving member even after the developer image has been transferred onto the transfer medium, a cleaning blade, used as a means for removing the residual developer, is put in contact with the surface of the light receiving member to scrape the residual developer therefrom and discharge the untransferred developer to the outside of the system.

As the materials for the light receiving member used as an electrophotographic photosensitive member, a variety of materials are proposed, including inorganic materials such as selenium, cadmium sulfide, zinc oxide, and amorphous silicon (hereinafter referred to as a-Si), organic materials, and so on. Of these materials, non-monocrystalline deposited films containing silicon atoms as a main component, typified by a-Si, for example amorphous deposited films of a-Si or the like containing hydrogen and/or halogen (for example, fluorine, chlorine, etc.) (for example, compensating for hydrogen or dangling bonds), are suggested as high-performance, high-durability, and nonpolluting photosensitive members and some of them are practically used. U.S. Pat. No. 4,265,991 discloses the technology of the electrophotographic photosensitive member the photoconductive layer of which is formed mainly of a-Si. Further, as techniques for enhancing water repellency and wear resistance, Japanese Patent Application Laid-Open No. 60-12554 (U.S. Pat. No. 4,559,289) discloses a surface layer containing carbon and halogen atoms in the surface of a photoconductive layer comprised of amorphous silicon containing silicon atoms, and Japanese Patent Application Laid-Open No. 2-111962 discloses a photosensitive member having a surface protecting-lubricating layer provided on an a-Si:H or a-C:H photosensitive layer. However, these publications include no description concerning the relationship between the electrophotographic process and the scraping property of the surface layer.

Since the a-Si base photosensitive members, typified by a-Si, have excellent properties that they demonstrate high sensitivity to light of long wavelengths such as semiconductor lasers (770 nm to 800 nm) and have little deterioration recognized after repetitive use, they are widely used as photosensitive members for electrophotography, for example, in high-speed copying machines, LBPs (laser beam printers), and so on.

As the methods for forming the silicon base non-monocrystalline deposited films, there are many known methods, including the sputtering method, the method of decomposing a source gas by heat (thermal CVD method), the method of decomposing a source gas by light (photo CVD method), the method of decomposing a source gas by plasma (plasma CVD method), and so on. Of these methods, the plasma CVD method, which is a method of decomposing a source gas by a glow discharge or the like generated by direct current, high frequency (RF or VHF), or microwave to form a deposited film on a desired substrate such as glass, quartz, a heat-resistant synthetic resin film, stainless steel, or aluminum are now under way to practical use, including not only the method of forming the amorphous silicon deposited films for electrophotography, but also methods for forming deposited films for the other uses, and there are also proposed various apparatuses for such methods.

For the light receiving members, there are recently required improvement in the electrophotographic characteristics matching with high-speed operation and vivider image quality. Therefore, in addition to the improvement in the characteristics of the photosensitive member, the grain diameters of the developer are being decreased and there are frequently used those developers having the weight average grain diameter of 5 to 8 $\mu$m measured by a coulter counter or the like.

As the charging and decharging means for the conventional light receiving members including the a-Si type light receiving member, there has been utilized in most cases the corona charger (corotron, scorotron) containing a wire electrode (a metal wire such as a gold plated tungsten wire of 50 to 100 $\mu$m$\phi$) and a shield plate as main components. That is, the charging and decharging of the light receiving member using the corona charger is carried out by applying a high voltage (about 4 to 8 kV) to the wire electrode to generate a corona current and allowing the corona current to act on the light receiving member. The corona charger is excellent in uniform charging and decharging.

However, the corona discharge is accompanied by generation of ozone ($O_3$). The ozone oxidizes nitrogen in the air to form nitrogen oxides (NOx). Further, the nitrogen oxides react with water in the air to form nitric acid and other products.

The products due to the corona discharge such as the nitrogen oxides, nitric acid, etc., adhere to and are deposited on the surface of the light receiving member and peripheral devices. Since the corona discharge products have a strong hygroscopic property, deposition of the corona discharge products on the surface of the light receiving member results in reduction of the resistance of the surface due to moisture absorption of the corona discharge products to substantially decrease the charge retaining capability of the light receiving member throughout or in part of the surface, which may cause the image defect called image smearing (the charge in the surface of the light receiving member leaks in the plane directions to destroy or fail to form an electrostatic latent image pattern).

Further, the corona discharge products adhering to the internal surface of a shield plate of the corona charger are evaporated and liberated not only during operation of the electrophotographic apparatus but also during quiescent periods of the apparatus, e.g. during the nighttime, and they then adhere to the surface of the light receiving member at a part thereof corresponding to the discharge aperture region of the charger and absorb moisture to decrease the resistance of the surface of the light receiving member.

As a result, it becomes easier to cause the image smearing in the first image or subsequent several images outputted when restarting the operation of the electrophotographic apparatus, at the region corresponding to the aperture portion of the charger.

Further, the a-Si type light receiving member has a surface hardness extremely higher than those of the other light receiving members. Therefore, the corona discharge product adhering to the surface of the light receiving member can not be removed by the ordinary cleaning step of the light receiving member surface, so that the corona discharge product is likely to remain on the light receiving member surface.

Thus, hitherto, it has been sometimes practiced to provide a heater for directly heating the light receiving member or to send hot air to the light receiving member by a hot air sending device to heat the light receiving member surface (at 30 to 50° C.) to thereby maintain the dry state, thus preventing the corona discharge products adhering to the light receiving member surface from absorbing moisture to substantially lower the resistance of the light receiving member surface and preventing the image smearing phenomenon from occurring. Most of the electrophotographic apparatuses using the a-Si type light receiving member have a heating/drying means incorporated therein.

Incidentally, the electrophotographic apparatuses are sometimes provided with a rotating cylindrical developer-carrying member containing a movable magnet or the like therein. In this case, there is widely used the method of forming on the carrying member a thin layer of a toner as the developer or a mixture of a toner and a carrier and then electrostatically transferring the toner onto a light receiving member having an electrostatic latent image formed thereon. For example, Japanese Patent Application Laid-Open Nos. 54-43037, 58-144865 and 60-7451 disclose the above method in which a developer such as a toner containing magnetic particles, i.e., a mixture of a toner and a carrier, or a toner containing magnetite but containing no carrier, or the like is used.

In such a developing method, there is a case where a portion of the rotating cylindrical developer-carrying member which is in opposition to the light receiving member expands by the heat radiated by the light receiving member during quiescent periods of the electrophotographic apparatus, so that the distance between the rotating cylindrical developer-carrying member and the light receiving member at the by the developer developing portion becomes short.

Reduction of the distance between the rotating cylindrical developer-carrying member and the light receiving member increases the electric field applied thereto to thereby allow the developer to be transferred more easily. This affects a portion at the side opposite the above mentioned portion to increase the distance between the above mentioned members to thereby decrease the electric field applied thereto, whereby the developer can be transferred with difficulty than usual. As a result, there is sometimes caused a problem of partial image density irregularity or the like at the period of rotation of the rotating cylindrical developer-carrying member. In order to obviate such phenomena, there is a need for an electrophotographic apparatus that causes no image smearing even when the light receiving member is not heated.

Further, with an electrophotographic apparatus in which the steps of charging, exposure, developing, transfer, separation, and cleaning are successively repeated and scrape cleaning with a blade is carried out, there is a case where the repeating operation gradually increases the wear resistance of the light receiving member surface. The increase of the wear resistance of the light receiving member surface promotes the degradation of the cleaning blade to lower the cleaning property for the remaining developer (hereinafter, referred to as "remaining toner").

When the copying step is repeated in this state, fine particles of the developer and additives (strontium titanate, silica, etc.) contained in the developer may be scattered in a corona charger to adhere to a wire electrode of the corona charger (hereinafter referred to as a charger wire), thereby causing discharge irregularities. When the discharge irregularities due to the contamination of the charger wire are caused, in the case of the positive development method (a method of developing unexposed portions of the surface of the light receiving member), image defects such as linear blank area portions on the image, scale-like black fogs spreading over the entirety of the image, local black dots (0.1 to 0.3 mmϕ) without periodicity, and so on may be caused.

Further, when the contamination of the charger wire is caused, abnormal discharge may be induced between the contaminated portion of the wire and the light receiving member, thus damaging the surface of the photosensitive member to cause white dot like image defects.

Further, in such a blade type cleaning method, there is a case where differences are made among amounts of the developer staying on the blade surface because of differences in character patterns in an original chart and uneven scraping may occur in the surface layer of the light receiving member. When such uneven scraping occurs, sensitivity irregularities appear as electrophotographic characteristics and result in density irregularities in an image. This phenomenon becomes more prominent particularly as the grain diameters of the developer decrease.

In recent years, there is a need for further higher quality of image characteristics, so that the decrease of the grain diameters of the developer is being advanced. The decrease of grain diameters of the developer improves the quality of image on one hand while tending to increase rubbing force by the blade on the other hand. This increase of rubbing force causes the developer (toner) to slip through the cleaning blade because of chatter or the like of the cleaning blade and this slipping of the developer may cause a black-line-like cleaning failure.

In addition, when the friction resistance is high, friction heat will rise between the light receiving member and the cleaning blade to raise the temperature, and this friction heat may cause a fusion phenomenon in which the developer used for thermal fixation firmly adheres to the surface of the light receiving member. Particularly, this fusion phenomenon becomes more prominent in proportion to the decrease of grain diameters of the developer; in the first stage the fusion phenomenon is too weak to affect the image; but repetitive use makes seeds of small fusion, gradually grows them and at last causes black-line-like image defects.

As the solutions to such circumstances, there are required the measures including a method of increasing the urging pressure of the cleaning blade, a method of increasing the hardness of the elastic rubber blade to increase the rubbing force in order to increase the force for scraping off the developer attached to the surface of the light receiving member, and so on. Increasing the hardness of the blade changes the property of the blade from a rubber-like state to a glass state and thus makes the material fragile, so as to shorten the lifetime of the blade. Further, the above methods tend to increase the frictional force against the surface of the light receiving member, so that there are some cases in which the uneven shaving of the surface layer is rather promoted.

Further, there are sometimes used the methods of providing means for rubbing the light receiving member surface to effectively remove the ozone products including the method of using the roller charging or transfer in which a conductive rubber roller is in contact with the light receiving member surface while being applied with a voltage to reduce the ozone amount and to effect rubbing, the method of providing an elastic rubber roller or magnetic roller in the cleaner in the cleaning step to recover the remaining toner and to rub the light receiving member surface, or the like method.

However, also in this case, successively repeating the steps of charging, exposure, developing, transfer, separation, and cleaning may change the surface property of the light receiving member surface to gradually increase the wear resistance thereof. The increase of the wear resistance of the light receiving member surface similarly promotes the degradation of the cleaning blade to lower the cleaning property for the remaining toner thus causing cleaning failure.

Further, the increase of the wear resistance of the light receiving member surface may promote the degradation of the elastic rubber roller used in roller charging, roller transfer, cleaning roller, and so on to cause cleaning blade to lower the cleaning property for the remaining toner thus causing charging failure, transfer failure or cleaning failure.

Further, when the elastic rubber roller for rubbing the light receiving member surface is degraded, there is generated a difference in the rubbing force to sometimes cause uneven scraping of the light receiving member surface. When such uneven scraping is caused, the sensitivity of the electrophotographic characteristics becomes nonuniform to cause density irregularities in the image.

This phenomenon becomes more prominent particularly as the grain diameters of the developer decrease. However, as described above, in recent years, there is a need for further higher quality of image characteristics, so that the decrease of the grain diameters of the developer is now being advanced.

As a countermeasure against the uneven scraping by a blade, fusion, etc. as described above, there has hitherto been sometimes employed a method of providing a magnet roller or a cleaning roller of urethane rubber, silicone rubber, or the like to uniformly spread the developer to reach the cleaning blade, thereby relaxing retention irregularities of the toner on the blade surface.

However, because the magnet roller is somewhat inferior in rubbing force to the elastic rubber roller, there is a case where the image smearing or the toner fused on the light receiving member surface can be removed only partly depending on the conditions such as the surface properties of the light receiving member, the electrophotographic process used, the service environment, or the like, thus failing to sufficiently exhibit the rubbing effect.

Incidentally, in recent years, the tendency to personal use of copying machines and printers requires the important subjects of size reduction, cost reduction, and less need for maintenance of the electrophotographic apparatuses, so that in terms of further energy saving and ecology, the apparatus is also desirably designed without provision of the means for directly or indirectly heating the light receiving member.

Under such circumstances, there are needs for the light receiving member that does not cause the image smearing without provision of the heating means and needs for the electrophotographic apparatus that does not cause uneven scraping and that can stably supply high image quality without density irregularities or fusion for a long term under any electrophotographic process conditions.

SUMMARY OF THE INVENTION

The present invention has been accomplished in view of the above mentioned problems, and an object of the invention is, therefore, to provide a light receiving member and an electrophotographic apparatus with the same that are free of or substantially free of uneven scraping of the light receiving member surface and can prevent the fusion of a developer.

Another object of the invention is to provide a light receiving member and an electrophotographic apparatus that can maintain high image quality regardless of the service environment.

A still another object of the invention is to provide a light receiving member and an electrophotographic apparatus that do not cause lowering of the image quality such as image smearing even without provision of the heating means of the light receiving member.

A yet another object of the invention is to provide a light receiving member and an electrophotographic apparatus that can prevent occurrence of the problems which are liable to be caused by the size reduction of the developer particles.

Again, another object of the invention is to provide a light receiving member for use in an electrophotographic apparatus for successively repeating the steps of charging, exposure, developing, transfer, separation, and cleaning and effecting scrape cleaning with a blade, which has a small wear resistance and is free of occurrence of contamination of the charge wire while preventing scattering of the toner and to provide a light receiving member and an electrophotographic apparatus to which the corona discharge products are difficult to adhere and in which even when the corona discharge products adheres to the surface, they can be removed easily, thereby providing a light receiving member and an electrophotographic apparatus that can supply a high quality image free from image smearing for a long term under any service environment.

Yet still anther object of the invention is to provide a light receiving member for use in an electrophotographic apparatus for successively repeating the steps of charging, exposure, developing, transfer, separation, and cleaning and rubbing the light receiving member surface with a rubbing roller, in which the repeated use does not increase the wear resistance, the rubbing roller is prevented from being degraded, cleaning failure is suppressed, and any fusion is not caused and to provide a light receiving member and an electrophotographic apparatus to which the corona discharge products are difficult to adhere and in which even when the corona discharge products adheres to the surface, they can be removed easily, thereby providing a light receiving member and an electrophotographic apparatus that can supply a high quality image free from image smearing for a long term under any service environment.

According to the present invention, there is provided an electrophotographic apparatus in which a light receiving member is rotated and the steps of charging, exposure, developing, transfer and cleaning are successively repeated and in which a developer of an average particle diameter of 5 to 8 $\mu$m is applied for developing onto a surface of the light receiving member and transferred from the light receiving member surface to a transfer medium and the light receiving member surface after the transfer of the developer is scrape-cleaned with an elastic rubber blade having the modulus of repulsion elasticity of not less than 10% nor more than 50%, wherein the light receiving member has a surface layer comprised of a non-monocrystalline fluorinated carbon film in which the wear loss after copying steps of 10,000 A4-size transfer sheets is not less than 0.1 Å nor more than 100 Å.

According to the present invention, there is further provided a light receiving member for an electrophotographic apparatus in which the light receiving member is rotated and the steps of charging, exposure, developing, transfer and cleaning are successively repeated and in which a developer of an average particle diameter of 5 to 8 $\mu$m is applied for developing onto a surface of the light receiving member and transferred from the light receiving member surface to a transfer medium and the light receiving member surface after the transfer of the developer is scrape-cleaned with an elastic rubber blade having the modulus of repulsion elasticity of not less than 10% nor more than 50%, wherein the light receiving member has a surface layer comprised of a non-monocrystalline fluorinated carbon film in which the wear loss after copying steps of 10,000 A4-size transfer sheets is not less than 0.1 Å nor more than 100 Å.

DESCRIPTION OF THE PREFERRED EMBODIMENTS

Figure 1A:
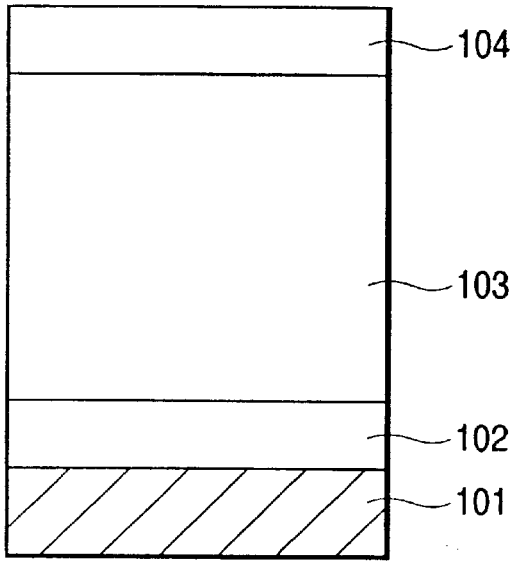
FIGS. 1A and 1B are schematic sectional structural views each showing a preferred example of the structure of a light receiving member for electrophotography.

The inventors have focused attention on the relationship between the electrophotographic process and the wear loss (wear amount) of the surface layer of the light receiving member and attempted to improve the water repellency and the wear property of the surface of the light receiving member in an electrophotographic process. As a consequence, the inventors have found that the combination of the electro-photographic process of the invention with the light receiving member the surface layer of which is comprised of the non-monocrystalline fluorinated carbon film of the invention allows the surface layer to contain fluorine atoms to be improved in water repellency and to prevent deposition of the corona discharge products thereon, that by adjusting the dynamic hardness of the surface layer within the range of 10 to 500 kgf/mm$^2$, optionally providing a rubbing means for rubbing the light receiving member surface in any step of the electrophotographic process, and further adjusting the wear loss of the light receiving member surface after copying steps of 10,000 sheets under the given conditions to be not less than 0.1 Å nor more than 100 Å, it is possible to anytime attain a fluorine atom-containing-surface while preventing desorption of only fluorine in the outermost surface, to incorporate fluorine into the surface layer to reduce the wear resistance of the surface and to improve the sliding properties, to prevent degradation of the elastic rubber roller possibly used as the rubbing means, also to prevent uneven scraping of the surface layer, cleaning failure and fusion, and to prevent occurrence of image smearing without provision of the heating means for the light receiving member regardless of the environmental conditions.

That is, according to the present invention, in an electrophotographic apparatus in which a light receiving member is rotated and the steps of charging, exposure, developing, transfer and cleaning are successively repeated, in which a rubbing means for rubbing the light receiving member surface is optionally provided in any one of the above steps, and in which a developer of an average particle diameter of 5 to 8 $\mu$m is applied for developing onto a surface of the light receiving member and transferred from the light receiving member surface to a transfer medium and the light receiving member surface after the transfer of the developer is scrape-cleaned with an elastic rubber blade having the modulus of repulsion elasticity of not less than 10% nor more than 50%, the light receiving member has a surface layer comprised of a non-monocrystalline fluorinated carbon film in which the wear loss after copying steps of 10,000 A4-size transfer sheets is not less than 0.1 Å nor more than 100 Å, the above mentioned excellent results are able to be achieved.

The term "modulus of repulsion elasticity" as used in the specification and claims refers to cushioning properties of an elastic member. The modulus of repulsion elasticity is determined by the modulus of repulsion elasticity test based on JIS (Japanese Industrial Standard) K 6301. Specifically, a test piece of an elastic member is held on a support of a modulus of repulsion elasticity testing machine such that a surface of the test piece is in the vertical direction. Then, a horizontally suspended round bar is allowed to fall freely from a predetermined height to collide perpendicularly with the surface of the test piece to thereby rebound. The modulus of repulsion elasticity is defined as the percentage of the rebound height of the horizontally suspended round bar relative to the predetermined height (i.e., the falling height of the bar).

When the modulus of repulsion elasticity of the cleaning blade used for the electrophotographic apparatus is smaller than 10%, the nature of the blade changes from a rubber-like state to a glass state, so that the material becomes fragile and tends to decrease the lifetime of the blade. When the modulus of repulsion elasticity of the cleaning blade is over 50%, there sometimes arise problems of occurrence of chattering of the blade resulting in lowering of the cleaning properties, rolling of the blade resulting in damage of the surface of the light receiving member, and so on. Thus, it is preferable that the modulus of repulsion elasticity of the cleaning blade is not less than 10% and not more than 50%.

As the materials for the cleaning blade used in the electrophotographic apparatus of the present invention, there are preferably employed urethane rubber, silicone rubber, butadiene rubber, isoprene rubber, nitrile rubber, natural rubber, and so on and particularly preferred materials are urethane rubber and silicone rubber which are generally used widely for electrophotographic apparatuses in terms of the hardness and ease to process.

On the other hand, in the present invention, for improving the cleaning property, the blade may be shaped into any form without any limitation as the occasion demands, for example, to a grooved blade as described in Japanese Patent Application Laid-Open No. 54-143149, a projection-added blade as described in Japanese Patent Application Laid-Open No. 57-124777, and so on. Incidentally, the publications neither describe nor suggest the relationship between the electrophotographic apparatus using the developing agent of small grain diameters and not provided with the heating means for the light receiving member, and the wear loss of the surface of the light receiving member having the surface layer of amorphous fluorinated carbon film.

When the rubbing means is provided in the cleaner, a magnet roller, an elastic rubber roller, or the like is employed. As the materials for the elastic rubber roller, there are generally used urethane rubber, silicone rubber, butadiene rubber, isoprene rubber, nitrile rubber, natural rubber, and so on. Further, the shape of the roller may include a sponge roller of an expanded material with large pores.

When the rubbing means is in the form of a charging roller which functions as the primary charger and also as the transfer charger, the materials generally used for the roller include urethane rubber, silicone rubber, butadiene rubber, isoprene rubber, nitrile rubber, natural rubber, and so on.

In the present invention, the dynamic hardness of the a-C:F surface layer used for the light receiving member is within the range of 10 to 500 kgf/mm$^2$. A dynamic hardness smaller than 10 kgf/mm$^2$ impairs the mechanical strength, while a dynamic hardness larger than 500 kgf/mm$^2$ reduces the wearing rate of the surface layer to make it difficult to scrape the surface layer, thus decreasing the scraping off effect for the corona discharge products with possible occurrence of image smearing. Further, the content of fluorine in the film of the surface layer is 5 to 50 atomic % in terms of F/(C+F), preferably 10% to 30%. If the fluorine content is less than 5%, there is a case where the water repellency and the wear properties can not be maintained. Further, if the fluorine content is over 50%, the adhesion and denseness of the film will be impaired to decrease the mechanical strength in certain cases.

When the surface layer, falling in the above ranges of the fluorine atom content and the dynamic hardness, is formed such that the wear loss after the copying steps on 10,000 A4-size transfer sheets (hereinafter, simply referred to as "10,000 sheets wear loss") is within the range of not less than 0.1 Å nor more than 100 Å, the chatter of the blade due to friction rarely occurs and partial stress in the blade surface and degradation of the rubbing roller are suppressed, thereby relieving local retention of the developer. In this regard, it should be noted that the wear loss is determined on the basis that the transfer of the A-4 size transfer sheet with regard to the light receiving member is carried out in the direction parallel to the short edge side of the sheet with the long edge side of the sheet being parallel to the longitudinal direction of the light receiving member. As a consequence, the surface layer is uniformly worn without uneven scraping, whereby the cleaning properties are excellent, scattering of the toner is eliminated to prevent contamination of the charge wire, the fusion can be prevented by the effect of scraping, and the wearing of the surface can be made uniform. Thus, even when the magnet roller with less wearing force than the elastic rubber roller is used as the rubbing means, it is possible to allow the surface layer of the light receiving member to wear uniformly. Further, the image smearing does not occur even under any environmental conditions without provision of the means for heating the light receiving member, because the corona discharge products adhering to the surface of the light receiving member are efficiently and evenly scraped off by the uniform wearing of the surface layer.

If the 10,000 sheets wear loss of the surface layer of the light receiving member used in the present invention is larger than 100 Å, the mechanical strength could be degraded in certain cases. If the wear loss is smaller than 0.1 Å, the surface layer would become resistant to wearing to reduce the effect of scraping the corona discharge products, thereby causing the image smearing in certain cases.

The optimum thickness of the surface layer used in the light receiving member of the present invention can be determined from the relationship between the wear loss of the surface layer and the lifetime of the electrophotographic apparatus, and it is generally in the range of 0.01 $\mu$m to 10 $\mu$m and preferably in the range of 0.1 $\mu$m to 1 $\mu$m. If the thickness of the surface layer is less than 0.01 $\mu$m, the mechanical strength could be degraded in certain cases. If the thickness is larger than 10 $\mu$m, the residual potential could become high in certain cases.

Embodiments of the present invention will be described with reference to the drawings.

Figure 1B:
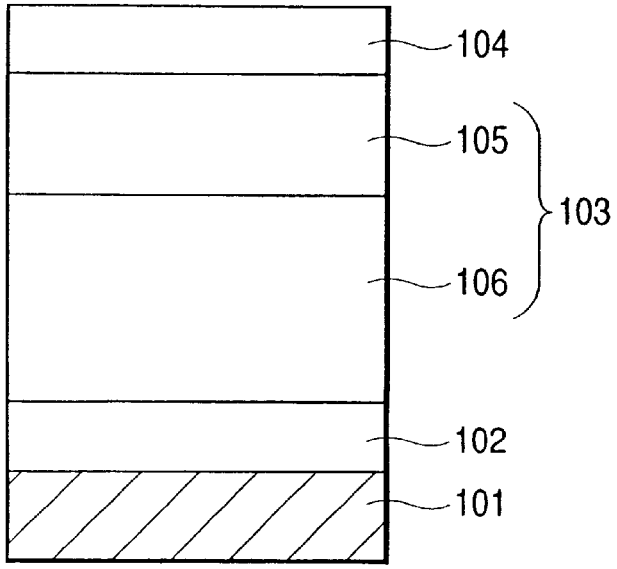

FIGS. 1A and 1B show schematic cross sections of suitable examples of the light receiving members according to the present invention. FIG. 1A shows an example of a single-layer type light receiving member in which the photoconductive layer is comprised of a single layer which is not functionally separated. FIG. 1B shows an example of a function-separated type light receiving member in which the photoconductive layer is separated into a charge generating layer and a charge transport layer.

The a-Si base light receiving member illustrated in FIG. 1A is composed of an electroconductive substrate 101 of aluminum or the like, and a charge injection inhibiting layer 102, a photoconductive layer 103, and a surface layer 104 stacked in this order on the surface of the conductive substrate 101. Here, the charge injection inhibiting layer 102 inhibits charge from being injected from the conductive substrate 101 into the photoconductive layer 103 and is provided as the occasion demands. The photoconductive layer 103 is comprised of an amorphous material containing at least silicon atoms and shows the photoconductive property. Further, the surface layer 104 is comprised of an a-C:H film containing carbon atoms and hydrogen atoms and has the capability of retaining a visible image in the electrophotographic apparatus.

In the following description it is assumed that the charge injection inhibiting layer 102 is present except when the effect differs depending upon either presence or absence of the charge injection inhibiting layer 102.

The a-Si base light receiving member illustrated in FIG. 1B is the light receiving member of the function-separated type in which the photoconductive layer 103 is comprised of a charge transport layer 106 made of an amorphous material containing at least silicon atoms and carbon atoms and a charge generating layer 105 made of an amorphous material containing at least silicon atoms, stacked in series. When this light receiving member is irradiated with light, carriers generated mainly in the charge generating layer 105 are transported through the charge transport layer 105 to reach the conductive substrate 101.

As the film-forming gases for the surface layer 104, there are preferably used gases of $CH_4$, $C_2H_6$, $C_3H_8$, $C_4H_{10}$, and so on, and gasifiable hydrocarbons. Further, when using these source gases for supply of carbon, they may be diluted with a gas such as $H_2$, He, Ar, or Ne, if necessary.

Figure 2:
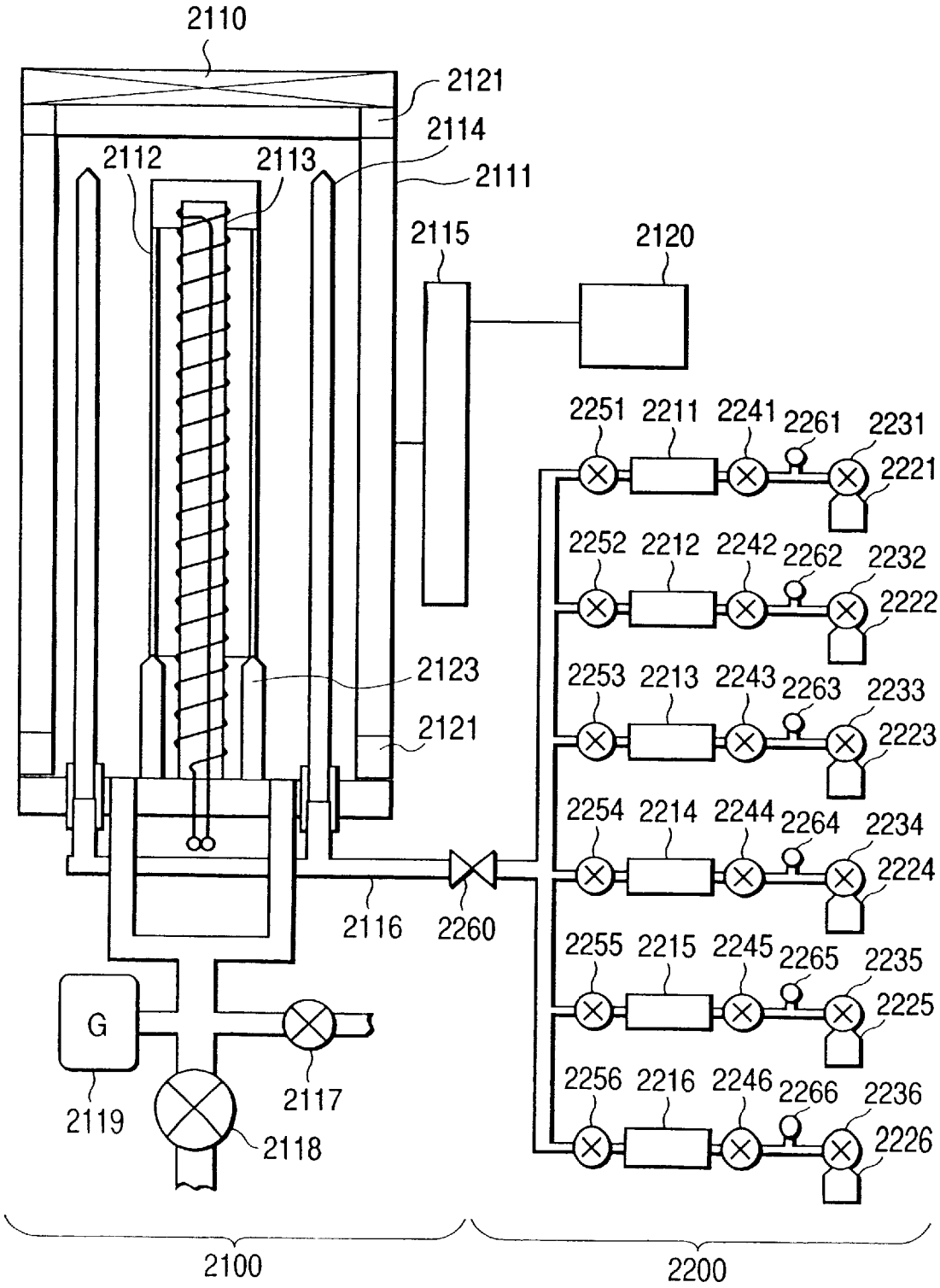
FIGS. 2 and 3 are schematic structural views each showing an example of a deposited film forming apparatus which can be used for producing a light receiving member for electrophotography applicable to the present invention.

FIG. 2 is a view schematically showing an example of a deposition apparatus preferably applicable to the production of for the light receiving member by the plasma CVD method (PCVD method).

This apparatus is generally composed of a deposition system 2100, a source gas supply system 2200, and an exhaust system (not illustrated) for reducing the pressure inside a reaction vessel 2110. Inside the reaction vessel 2110 in the deposition system 2100 there are a cylindrical film-formed substrate 2112 connected to the earth, a heater 2113 for heating the cylindrical film-forming substrate, and source gas inlet pipes 2114, and a high-frequency power source 2120 is connected to the vessel via a high-frequency matching box 2115.

The source gas supply system 2200 is composed of source gas cylinders 2221 to 2226 of $SiH_4$, $H_2$, $CH_4$, NO, $B_2H_6$, $CH_4$, etc., valves 2231 to 2236, 2241 to 2246, 2251 to 2256, and mass flow controllers 2211 to 2216, and the cylinders of the respective component gases are connected through a valve 2260 to the gas inlet pipes 2114 in the reaction vessel 2110. Numeral 2121 denotes an insulating material.

The cylindrical film-forming substrate 2112 is set on an electroconductive receiver 2123 to be earthed thereby.

Described below is an example of procedures in a forming method of the light receiving member, using the apparatus of FIG. 2.

The cylindrical film-forming substrate 2112 is set in the reaction vessel 2110 and the inside of the reaction vessel 2110 is evacuated by the exhaust system not illustrated (for example, a vacuum pump). Then the temperature of the cylindrical film-forming substrate 2112 is controlled to a desired temperature in the range of 20° C. to 500° C. by the heater 2113 for heating the cylindrical film-forming substrate. For letting the source gases for formation of the light receiving member into the reaction vessel 2110, after confirming that the valves 2231 to 2236 of the gas cylinders and a leak valve 2117 of the reaction vessel are closed and that the inflow valves 2241 to 2246, outflow valves 2251 to 2256, and auxiliary valve 2260 are opened, the main valve 2118 is next opened to evacuate the reaction vessel 2110 and gas supply pipe 2116.

After that, when a reading of vacuum gage 2119 reaches 0.7 Pa, the auxiliary valve 2260 and outflow valves 2251 to 2256 are closed. Thereafter, each gas is introduced from the gas cylinder 2221 to 2226 with opening the corresponding valve 2231 to 2236 and the pressure of each gas is adjusted to $1.96\times10^5$ by pressure adjuster 2261 to 2266. The inflow valve 2241 to 2246 is then gradually opened to introduce each gas into the mass flow controller 2211 to 2216. The above procedures complete preparation for film formation and thereafter formation of the photoconductive layer is first effected on the cylindrical film-forming substrate 2112.

When the cylindrical film-forming substrate 2112 reaches the desired temperature, necessary valves out of the outflow valves 2251 to 2256 and the auxiliary valve 2260 are gradually opened to introduce the desired source gases from the corresponding gas cylinders 2221 to 2226 through the gas inlet pipes 2114 into the reaction vessel 2110. Next, each source gas is regulated at a desired flow rate by each mass flow controller 2211 to 2216. On that occasion, the aperture of the main valve 2118 is adjusted with observing the vacuum gage 2119 so that the pressure inside the reaction vessel 2110 becomes the desired pressure of not more than 133 Pa. When the internal pressure becomes stable, the high-frequency power source 2120 is set to a desired power and the high-frequency power, for example, of the frequency in the range of 1 MHz to 450 MHz is supplied via the high-frequency matching box 2115 to the cathode electrode 2111 to induce a high-frequency glow discharge. This discharge energy decomposes each source gas introduced into the reaction vessel 2110, whereby the desired photoconductive layer with the matrix of silicon atoms is deposited on the cylindrical film-forming substrate 2112. After the film is formed in the desired thickness, the supply of the high-frequency power is stopped and each outflow valve 2251 to 2256 is closed to stop the inflow of each source gas into the reaction vessel 2110, thereby completing the formation of the photoconductive layer.

The composition and thickness of the photoconductive layer can be known ones. The surface layer can also be formed on the above photoconductive layer basically by repeating the above operation.

Figure 3:
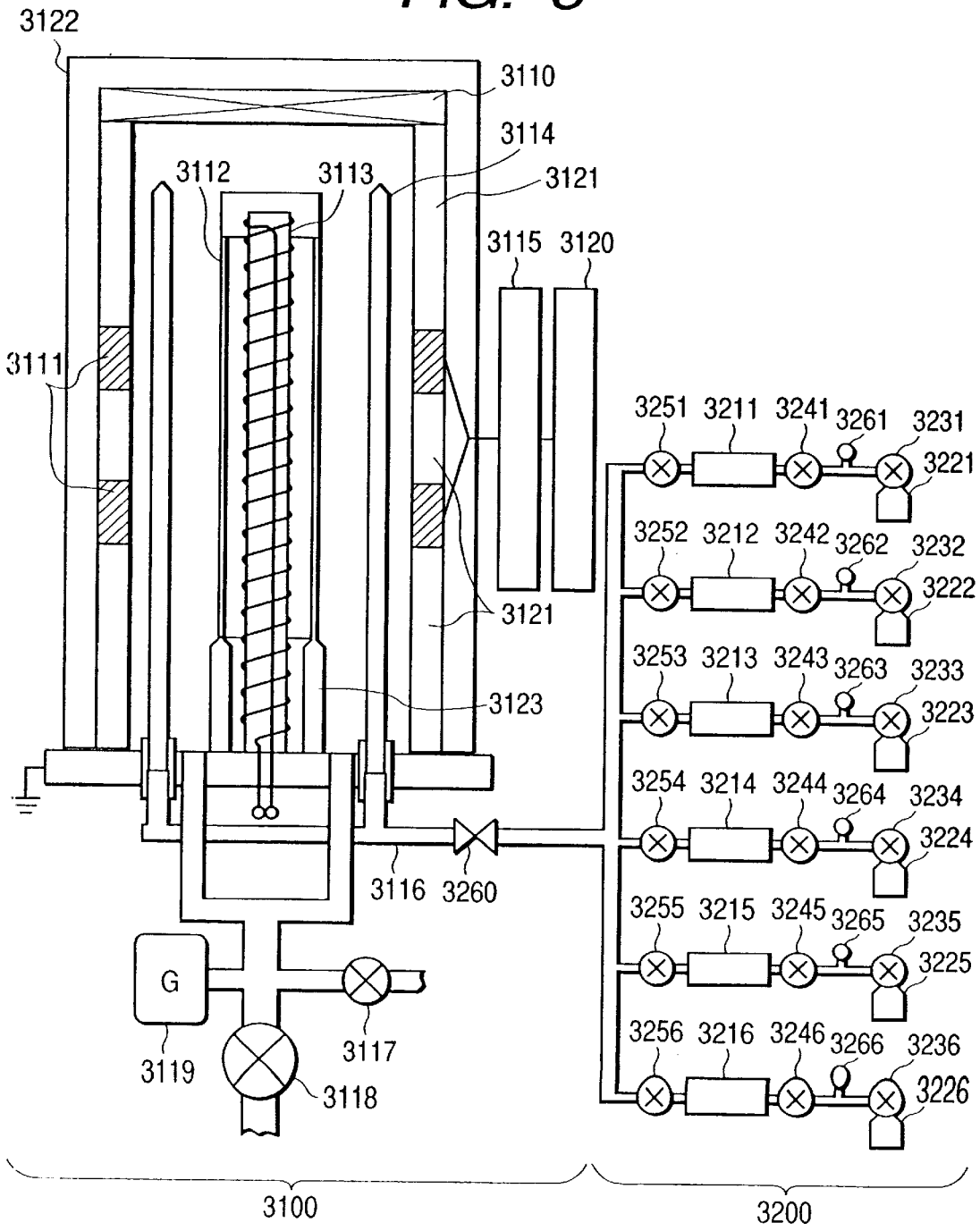

FIG. 3 is a view schematically showing another example of the deposition apparatus preferably applicable to the production of the light receiving member by the plasma CVD method using the high-frequency power source.

This apparatus is generally composed of a deposition system 3100, a source gas supply system 3200, and an exhaust system (not illustrated) for reducing the pressure inside a reaction vessel 3110. Inside the reaction vessel 3110 in the deposition system 3100 there are a cylindrical film-forming substrate 3112 connected to the earth, a heater 3113 for heating the cylindrical film-forming substrate, and source gas inlet pipes 3114, and a high-frequency power source 3120 is connected to the vessel via high-frequency matching box 3115.

The source gas supply system 3200 is composed of source gas cylinders 3221 to 3226 of $SiH_4$, $H_2$, $CH_4$, NO, $B_2H_6$, $CH_4$, etc., valves 3231 to 3236, 3241 to 3246, 3251 to 3256, and mass flow controllers 3211 to 3216, and the cylinders of the respective component gases are connected through a valve 3260 to the gas inlet pipes 3114 in the reaction vessel 3110.

The cylindrical film-forming substrate 3112 is set on an electroconductive receiver 3123 to be earthed thereby. Cathode electrode 3111 is made of an electroconductive material and is insulated by insulating material 3121. Numeral 3122 denotes an insulating shielding plate.

As the electroconductive material used for the electroconductive receiver 3123, there can be employed copper, aluminum, gold, platinum, lead, nickel, cobalt, iron, chromium, molybdenum, titanium, stainless steel, composite materials of two or more of these materials, and so on.

As the insulating material for insulating the cathode electrode 3111, there can be employed such insulating materials as ceramics, Teflon, mica, glass, quartz, silicone rubber, polyethylene, polypropylene, and so on.

The matching box 3115 preferably used herein is one of any structure as long as it can match the load with the high-frequency power source 3120. A preferred matching method is one to effect automatic matching, but a manual matching method can also be applied without affecting the effect of the present invention at all.

As the material for the cathode electrode 3111 to which the high-frequency power is applied, there can be employed copper, aluminum, gold, silver, platinum, lead, nickel, cobalt, iron, chromium, molybdenum, titanium, stainless steel, composite materials of two or more of these materials, and so on. The shape of the cathode electrode is preferably a cylindrical shape, but it may be elliptic or polygonal as occasion may demand.

The cathode electrode 3111 may be provided with a cooling means if necessary. As specific cooling means, water, air, liquid nitrogen, a Peltier element, or the like is used as occasion may demand.

The cylindrical film-forming substrate 3112 used in the present invention may be any one of a material and in a shape according to the purpose of use. For example, the shape is desirable cylindrical for production of the photosensitive member for electrophotography, but the shape may be a flat plate shape or any other shape as occasion may demand. As the material therefor, there can be employed copper, aluminum, gold, silver, platinum, lead, nickel, cobalt, iron, chromium, molybdenum, titanium, stainless steel, composite materials of two or more of these materials, materials of such a structure that an electroconductive material covers an insulating material such as polyester, polyethylene, polycarbonate, cellulose acetate, polypropylene, polyvinyl chloride, polyvinylidene chloride, polystyrene, glass, quartz, ceramics, or paper, and so on.

Described below is an example of procedures in a forming method of the light receiving member, using the apparatus of FIG. 3.

The cylindrical film-forming substrate 3112 is set in the reaction vessel 3110 and the inside of the reaction vessel 3110 is evacuated by the exhaust system not illustrated (for example, a vacuum pump). Then the temperature of the cylindrical film-forming substrate 3112 is controlled to a desired temperature in the range of 20° C. to 500° C. by the heater 3113 for heating the cylindrical film-forming substrate.

For letting the source gases for formation of the light receiving member into the reaction vessel 3110, after confirming that the valves 3231 to 3236 of the gas cylinders and a leak valve 3117 of the reaction vessel are closed and that the inflow valves 3241 to 3246, outflow valves 3251 to 3256, and auxiliary valve 3260 are opened, a main valve 3118 is next opened to evacuate the reaction vessel 3110 and a gas supply pipe 3116.

After that, when a reading of a vacuum gage 3119 reaches 0.7 Pa, the auxiliary valve 3260 and outflow valves 3251 to 3256 are closed. Thereafter, each gas is introduced from the gas cylinder 3221 to 3226 with opening the corresponding valve 3231 to 3236 and the pressure of each gas is adjusted to 2 kg/cm$^2$ by pressure adjuster 3261 to 3266. The inflow valve 2341 to 3246 is then gradually opened to introduce each gas into the mass flow controller 3211 to 3216. The above procedures complete preparation for film formation and thereafter formation of the photoconductive layer is effected on the cylindrical film-forming substrate 3112.

When the cylindrical film-forming substrate 3112 reaches the desired temperature, necessary valves out of the outflow valves 3251 to 3256 and the auxiliary valve 3260 are gradually opened to introduce the desired source gases from the corresponding gas cylinders 3221 to 3226 through the gas inlet pipes 3114 into the reaction vessel 3110. Next, each source gas is regulated at a desired flow rate by each mass flow controller 3211 to 3216. On that occasion, the aperture of the main valve 3118 is adjusted with observing the vacuum gage 3119 so that the pressure inside the reaction vessel 3110 becomes the desired pressure of not more than 133 Pa. When the internal pressure becomes stable, the high-frequency power source 3120 is set to a desired power and the high-frequency power, for example, of the frequency in the range of 1 MHz to 450 MHz is supplied via the high-frequency matching box 3115 to the cathode electrode 3111 to induce a high-frequency glow discharge. This discharge energy decomposes each source gas introduced into the reaction vessel 3110, whereby the desired deposited film with the matrix of silicon atoms is deposited on the cylindrical film-forming substrate 3112. After the film is formed in the desired thickness, the supply of the high-frequency power is stopped and each outflow valve 3251 to 3256 is closed to stop the inflow of each source gas into the reaction vessel 3110, thereby completing the formation of the deposited film.

The surface layer of the present invention can also be formed basically by repeating the above operation. Specifically, necessary valves out of the outflow valves 3251 to 3256 and the auxiliary valve 3260 are gradually opened to introduce source gases necessary for the surface layer from the corresponding gas cylinders 3221 to 3226 through the gas inlet pipes 3114 into the reaction vessel 3110. Then each source gas is adjusted to a predetermined flow rate by the corresponding mass flow controller 3211 to 3216. On that occasion, the aperture of the main valve 3118 is adjusted with observing the vacuum gage 3119 so that the pressure inside the reaction vessel 3110 becomes the predetermined pressure of not more than 133 Pa. When the internal pressure becomes stable, the high-frequency power source 3120 is set to a desired power and the high-frequency power of the frequency in the range of 1 MHz to 450 MHz is supplied via the high-frequency matching box 3115 to the cathode electrode 3111 to induce a high-frequency glow discharge. This discharge energy decomposes each source gas introduced into the reaction vessel 3110, whereby the surface layer is formed. After completion of the formation of the surface layer in the desired thickness, the supply of the high-frequency power is stopped and each outflow valve 3251 to 3256 is closed to stop the flow of each source gas into the reaction vessel 3110, thereby completing the formation of the surface layer.

Incidentally, the cylindrical film-forming substrate 3112 may be rotated at a predetermined speed by a driving device (not illustrated) during the period of film formation.

Figure 4:
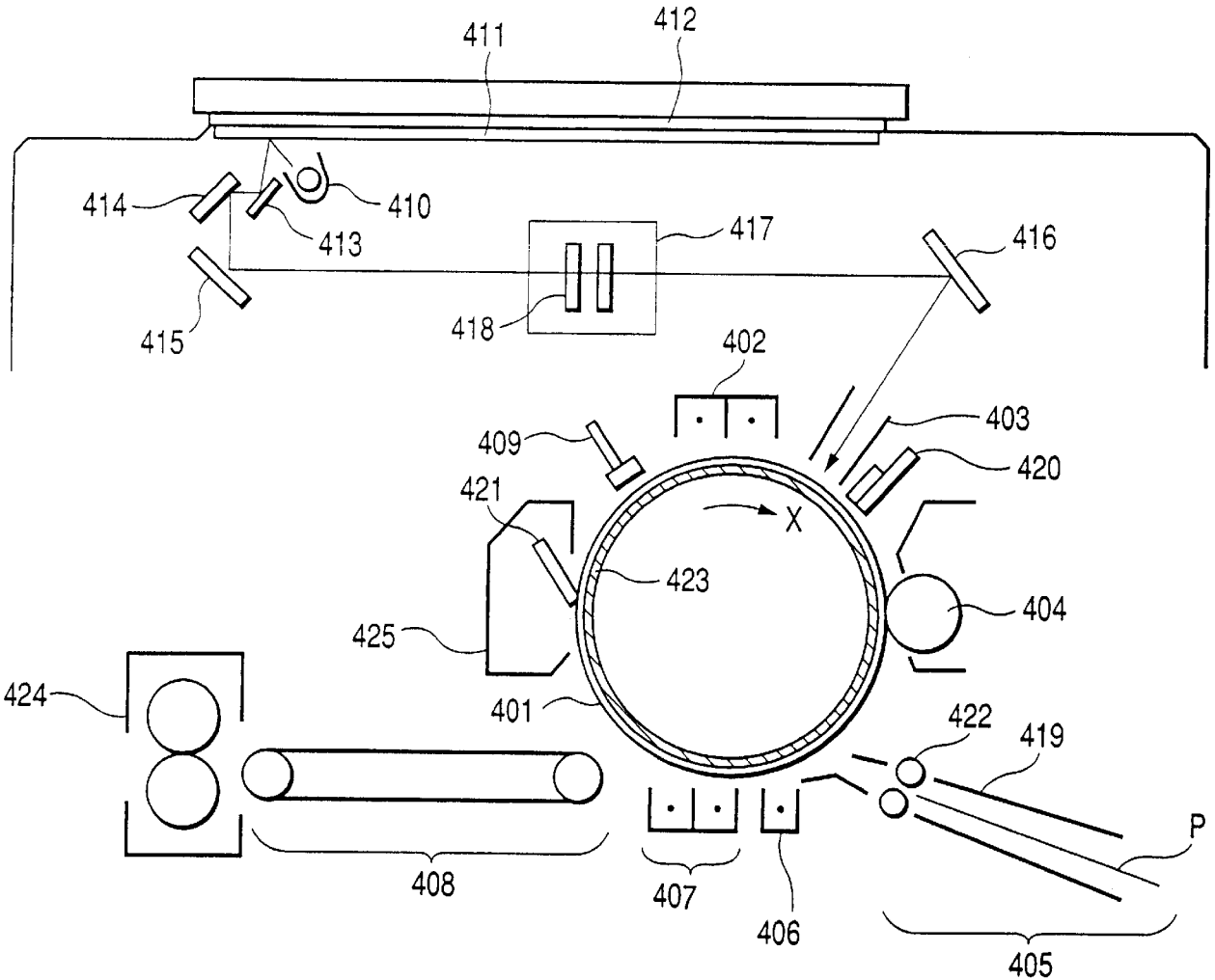
FIGS. 4 and 5 are schematic structural views each showing an example of the structure of the electrophotographic apparatus in accordance with the present invention.

FIG. 4 is a schematic view showing an example of the structure of the electrophotographic apparatus for explaining an example of an image forming process of the electrophotographic apparatus, in which the light receiving member 401 is arranged to be capable of being temperature-controlled by a surface heater 423 provided inside thereof and to be rotated in the direction of arrow X as occasion may demand. Around the light receiving member 401 there are provided a primary charger 402, an electrostatic latent image forming portion 403, a developing device 404, a transfer medium supplying system 405, a transfer charger 406, a separation charger 40, a cleaner 425, a conveying system 408, a charge-eliminating light source 409, and so on as occasion may demand.

Described below is a specific example of the image forming process. The light receiving member 401 is uniformly charged by the primary charger 402 to which the high voltage of +6–8 kV is applied. A light emitted from a lamp 410 is projected onto an original 412 placed on an original plate 411, the reflected light is guided via mirrors 413, 414, 415 to be focused by lenses 418 of a lens unit 417, the light is guided via a mirror 416 to be projected as an information carrying light onto an electrostatic latent image portion to form an electrostatic latent image on the light receiving member 401. A developer of the negative polarity is supplied from the developing device 404 onto the latent image to form a developer image. Incidentally, this exposure may also be carried out by scanning exposure with the information carrying light, using an LED array, a laser beam, or a liquid crystal shutter or the like, instead of the reflection from the original 412.

On the other hand, a transfer medium P such as paper is supplied through the transfer medium supply system 405 toward the photosensitive member 401 while adjusting the leading-end supply timing by a registration roller 422. Numeral 419 denotes a transfer medium supply guide. The transfer medium P is given a positive electric field of the opposite polarity to that of the developer from the back surface in the gap between the transfer charger 406 to which the high voltage of +7–8 kV is applied, and the light receiving member 401, whereby the developer image of the negative polarity on the surface of the light receiving member is transferred onto the transfer medium P. Then the transfer medium P is separated from the light receiving member 401 by the separation charger 407 to which the high AC voltage of 12 to 14 kVp-p and 300 to 600 Hz is applied. Subsequently, the transfer medium P passes through the transfer conveying system 408 to a fixing device 424 to fix the developer image, and then the transfer medium is conveyed to the outside of the apparatus.

The developer remaining on the light receiving member 401 is collected by a cleaning blade 421 made of an elastic material such as silicone rubber, urethane rubber, etc. provided in the cleaner 425, and the electrostatic latent image remaining thereon is erased by the charge-eliminating light source 409.

Numeral 420 designates a blank exposure LED, which is provided for exposing the light receiving member 401 to light with necessity so as to prevent the unwanted developer from adhering to portions outside the width of the transfer medium P and to non-image areas such as margin portions in the light receiving member 401.

Figure 5:
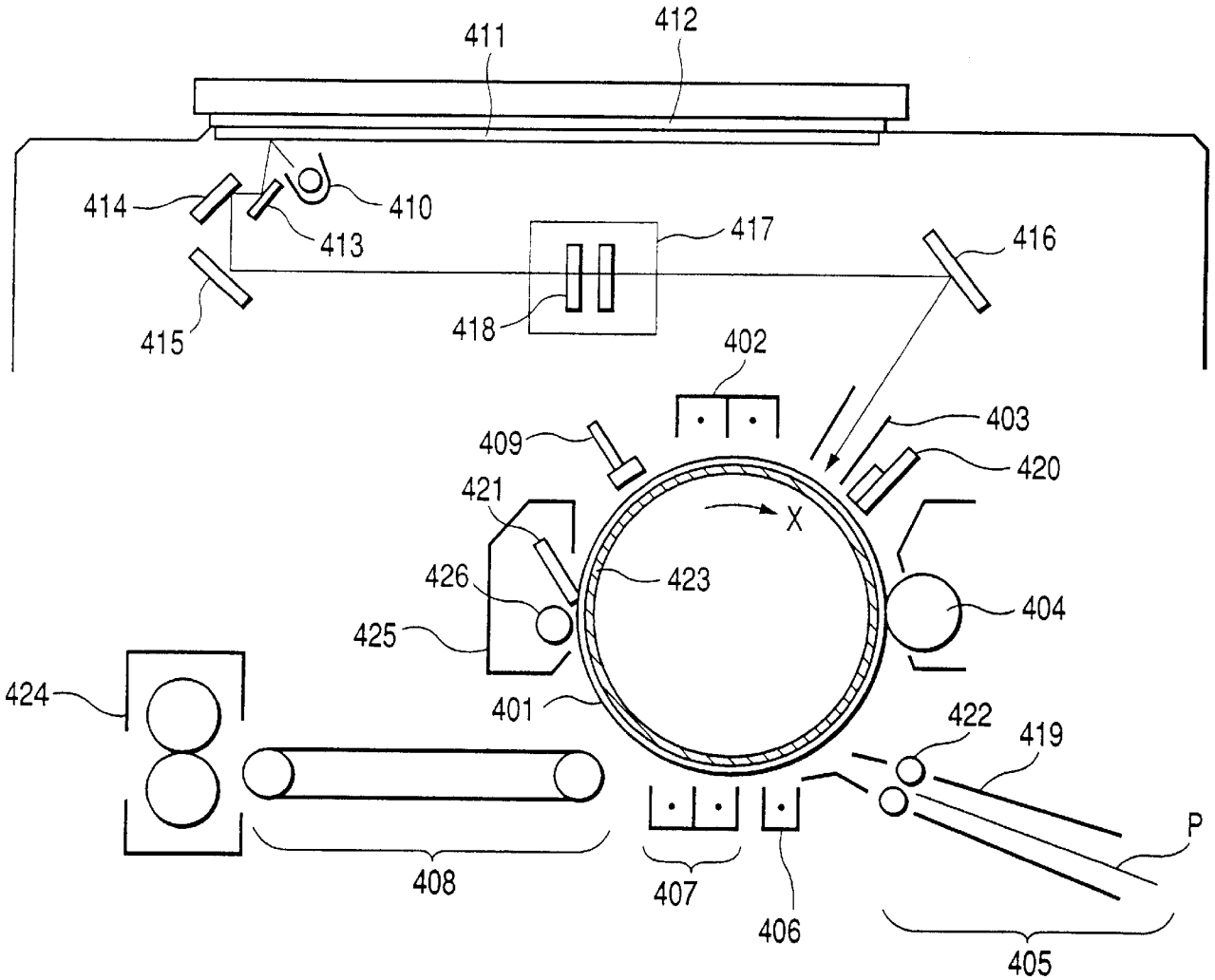

FIG. 5 is a schematic view showing another example of the electrophotographic apparatus. The electrophotographic apparatus shown in FIG. 5 is different from the apparatus of FIG. 4 in that the cleaner 425 as the cleaning means has not only the cleaning blade 421 but also the cleaning roller 426. Thus, the cleaning step in the electrophotographic apparatus of FIG. 5 is carried out as follows.

The developer remaining on the light receiving member 401 is recovered by a magnetic roller 426 or a cleaning roller 426 made of an elastic material such as silicone rubber, urethane rubber, etc. and a cleaning blade 421 made of an elastic material such as silicone rubber, urethane rubber, etc. provided in the cleaner 425, and the electrostatic latent image remaining thereon is erased by the charge-eliminating light source 409 similarly as above.

EXAMPLES

The present invention will be described in further detail using examples thereof, but it should be noted that the present invention is by no means intended to be limited to these examples.

Example 1

Using the plasma CVD apparatus illustrated in FIG. 2, light receiving members were produced by stacking the lower inhibiting layer and the photoconductive layer on the cylindrical conductive substrate under the conditions of Table 1 and thereafter depositing the surface layer in a thickness of 0.5 μm under the conditions of Table 2.

Separately, surface layers were deposited in a thickness of 0.5 μm under the conditions of Table 2 on 7059 glass substrates (mfd. by Corning Glassworks) to prepare a-C:F surface layer samples of 1A to 1C, as samples for measuring the fluorine content of the surface layer.

With these surface layer samples of 1A to 1C, the fluorine content F/(C+F) was measured by the ESCA analysis and the dynamic hardness was then measured using a dynamic ultrafine hardness meter (trade name: DUH-201, mfd. by Shimadzu Corp.). The dynamic hardness was represented by the value obtained when an indenter of a triangular pyramid having a radius of curvature of tip of not more than 0.1 μm and an edge-to-edge angle of 115° was used and the indenter was forced into the sample until a 0.1 gf load was attained.

As a result, the fluorine contents and dynamic hardness of the surface layers of the light receiving members 1A to 1C were the values shown in Table 3.

Then, each of the light receiving members 1A to 1C was mounted in a modified machine from the copying machine NP-6085 manufacture by CANON K. K. and was evaluated as to the cleaning property by a durability test of continuous passage of 100,000 A4-size transfer sheets (with conveying the A4-size sheet in the direction parallel to the short edge thereof) at the moving speed of the light receiving member of 300 mm/sec. The elastic rubber blade 421 used was an urethane rubber blade having the modulus of repulsion elasticity of 10%. The developing agent used was one having the average grain diameter of 6.5 μm, because the fusion was likely to occur with smaller grain diameters of the developer. Further, the temperature of the surface of the light receiving member was controlled to 60° C. to obtain the condition under which the fusion became easier to occur. The wear losses of the surface layers after the durability test are also shown in Table 3. The wear losses of the surface layers were obtained by measuring the thicknesses of the surface layers before and after the durability test by a reflection spectroscopic interferometer and calculating the wear losses per 10,000 sheets from these values.

Further, the light receiving members of 1A to 1C were evaluated as to the image smearing by carrying out the durability test of 100,000 sheets under the environment of 35° C. and relative humidity 90% without provision of the heating means. The elastic rubber blade 421 used was an urethane rubber blade having the modulus of repulsion elasticity of 10% and the cleaning conditions were so set as to effect such scrape cleaning that the urging pressure of the blade was 80% of the ordinary pressure.

The results obtained by the above evaluation are shown in Table 4.

Next, the methods of evaluation for uneven scraping, fusion and cleaning failure are described below with reference to FIG. 4, respectively.

(Evaluation method of uneven scraping)

The charging current of the primary charger 402 is adjusted so that the dark area potential is 400 V at the position of the developing device 404. An original 412 having vertical lines of solid black is placed on the original plate 411. The durability test is conducted by having some portions always rubbed with the developer and the other portions always not rubbed therewith in the direction of the generating line of the surface of the light receiving member. After that, the charging current of the primary charger 402 is adjusted so that the dark area potential is 400 V at the position of the developing device 404. Then a solid white original 412 is placed on the original plate 411. The on voltage of the halogen lamp 410 is adjusted so that the light area potential is 50 V. After that, an original 412 with the reflection density of 0.3 is placed and potential irregularities are measured at this time. The potential irregularities are evaluated by percentage of change of a potential of an unevenly scraped portion to a potential of a normal portion.

Criteria for the evaluation are as follows.

a: Good image without sensitivity irregularities b: Image in practically acceptable level, though there are potential irregularities not more than 2.5% c: Image with linear, density irregularities while there are potential irregularities over 2.5%.

(Fusion evaluation method)

The charging current of the primary charger 402 is adjusted so that the dark area potential is 400 V at the position of the developing device 404. Then the original 412 of solid white is placed on the original plate 411. The on voltage of the halogen lamp 410 is adjusted so that the light area potential is 50 V. Thereafter, a solid white image of A3 size is made. This image is used to observe whether black dots appear due to the fusion of the developer and the surface of the light receiving member is also observed with a microscope.

Criteria for the evaluation are as follows.

a: Good image without fusion b: Image having no black dot while small fusion of not more than 10 $\mu$m is observed in the observation with the microscope (though it poses no practical problem)

c: Image having black dots (Cleaning failure evaluation method)

The charging current of the primary charger 402 is adjusted so that the dark area potential is 400 V at the position of the developing device 404. The original 412 with the reflection density of 0.3 is placed on the original table 411. The on voltage of the halogen lamp 410 is adjusted so that the light area potential is 200 V, and a halftone image of A3 size is made. This image is used to observe whether a cleaning failure occurs in a linear pattern.

Criteria for the evaluation are as follows.

a: Good image without a cleaning failure b: Image in practically acceptable level, though there are one or two cleaning failures not greater than the width 1 mm and the length 1 cm c: Image having three or more cleaning failures not greater than the width 1 mm and the length 1 cm or image having a cleaning failure greater than the width 1 mm and the length 1 cm.

The results obtained by the above evaluation are shown in Table 5.

As is seen from Table 5, the light receiving members 1A, 1B, and 1C had neither the image defect of the black line pattern caused by uneven scraping even after the durability test of 100,000 sheets nor the image defects due to the cleaning failure, the fusion, and the like at all. Further, good image characteristics were also achieved as to the image smearing without provision of the heating means for the light receiving member.

Comparative Example 1

In the similar fashion to Example 1, using the plasma CVD apparatus illustrated in FIG. 2, the light receiving members 1A', 1B', 1C' were produced by stacking the lower inhibiting layer and the photoconductive layer on the cylindrical conductive substrate under the conditions of Table 1 and thereafter depositing the surface layer in a thickness of 0.5 $\mu$m under the conditions of Table 6.

Separately, a-C:F surface layer samples of 1A' to 1C' were each prepared on the 7059 glass substrate under the conditions of Table 6, and the fluorine contents and dynamic hardness of the surface layers of 1A' to 1C' were measured by the similar method to that in Example 1.

As a result, the fluorine contents and dynamic hardness of the surface layers of the light receiving members 1A' to 1C' were the values shown in Table 7.

Next, each of these light receiving members 1A' to 1C' was mounted in the modified machine from the copying machine NP-6085 manufacture by CANON K. K., and the durability test was conducted under the conditions similar to those in Example 1. However, the moving speed of the light receiving member was 300 mm/sec and the blade 421 used was an urethane rubber blade having the modulus of repulsion elasticity of 8%. The wear losses of the surface layers after this durability test are shown in Table 7.

Further, the results of evaluation for uneven scraping, fusion and cleaning failure made in the same manner as in Example 1 are shown in Table 8, and the results of evaluation for image smearing are shown in table 9.

As is seen from the tables, the image defect of linear pattern due to uneven scraping occurred by the durability test of 100,000 sheets. Further, the image smearing was evaluated by the durability test under the conditions without provision of the heating means with the result that image smearing sometimes occurred.

Example 2

In the similar fashion to Example 1, using the plasma CVD apparatus illustrated in FIG. 2, the light receiving members 1D, 1E, 1F were each produced by stacking the lower inhibiting layer and the photoconductive layer on the cylindrical conductive substrate under the conditions of Table 1 and thereafter depositing the surface layer in a thickness of 0.5 $\mu$m under the conditions of Table 10.

Separately, a-C:F surface layer samples of 1D to 1F were each prepared on the 7059 glass substrate under the conditions of Table 10, and the fluorine contents and dynamic hardness of the surface layers of 1D to 1F were measured by the similar method to that in Example 1.

As a result, the fluorine contents and dynamic hardness of the surface layers of the light receiving members 1D to 1F were the values shown in Table 11.

Next, each of these light receiving members 1D to 1F was mounted in the modified machine from the copying machine NP-6085 manufacture by CANON K. K., and the durability test was conducted under the conditions similar to those in Example 1. However, the moving speed of the light receiving member was 400 mm/sec and the blade 421 used was an urethane rubber blade having the modulus of repulsion elasticity of 25%. The wear losses of the surface layers after this durability test are shown in Table 11.

Further, the light receiving members of 1D to 1F were evaluated as to the image smearing by carrying out the durability test of 100,000 sheets under the environment of 35° C. and relative humidity 90% without provision of the heating means. The cleaning conditions were so set as to effect such scrape cleaning that the urging pressure of the blade was 80% of the ordinary pressure.

Further, the results of evaluation for uneven scraping, fusion and cleaning failure made in the same manner as in Example 1 are shown in Table 5.

As is seen from Tables 4 and 5, the light receiving members 1D to 1F had neither the image defect of the linear pattern caused by the uneven scraping even after the durability test of 100,000 sheets nor the image defects due to cleaning failure, fusion, and the like at all. Further, concerning the image smearing, good image characteristics were obtained without provision of the heating means for the light receiving member.

Comparative Example 2

In the similar fashion to Example 1, using the plasma CVD apparatus illustrated in FIG. 2, the light receiving members 1D', 1E', 1F' were produced by stacking the lower inhibiting layer and the photoconductive layer on the cylindrical conductive substrate under the conditions of Table 1 and thereafter depositing the surface layer in a thickness of 0.5 $\mu$m under the conditions of Table 12.

Separately, a-C:F surface layer samples of 1D' to 1F' were each prepared on the 7059 glass substrate under the conditions of Table 12, and the fluorine contents and dynamic hardness of the surface layers of 1D' to 1F' were measured by the similar method to that in Example 1.

As a result, the fluorine contents and dynamic hardness of the surface layers of the light receiving members 1D' to 1F' were the values shown in Table 13.

Next, each of these light receiving members 1D' to 1F' was mounted in the modified machine from the copying machine NP-6085 manufacture by CANON K. K., and the durability test was conducted under the conditions similar to those in Example 1. However, the moving speed of the light receiving member was 400 mm/sec and the blade 421 used was an urethane rubber blade having the modulus of repulsion elasticity of 5%. The wear losses of the surface layers after this durability test are shown in Table 13.

Further, the results of evaluation for uneven scraping, fusion and cleaning failure made in the same manner as in Example 1 are shown in Table 8, and the results of evaluation for image smearing are shown in Table 9.

As is seen from the tables, although the fusion and the image smearing were of the practically acceptable level, there were cases where image defects in a liner pattern due to scratches and uneven scraping occurred by the durability test of 100,000 sheets.

Example 3

In the similar fashion to Example 1, using the plasma CVD apparatus illustrated in FIG. 3, the light receiving members 1G, 1H, 1I were produced by stacking the lower inhibiting layer, charge transport layer and charge generating layer on the cylindrical conductive substrate under the conditions of Table 14 and thereafter depositing the surface layer in a thickness of 0.5 $\mu$m under the conditions of Table 15.

Further, a-C:H surface layer samples of G to I were each prepared on the silicon wafer under the conditions of Table 15, and the hydrogen contents of the surface layers of G to I were measured by the similar method to that in Example 1. Separately, a-C:F surface layer samples of 1G to 1I were each prepared on the 7059 glass substrate under the conditions of Table 15, and the fluorine contents and dynamic hardness of the surface layers of 1G to 1I were measured by the similar method to that in Example 1.

As a result, the fluorine contents and dynamic hardness of the surface layers of the light receiving members 1G to 1I were the values shown in Table 16.

Next, each of these light receiving members 1G to 1I was mounted in the modified machine from the copying machine NP-6085 manufacture by CANON K. K., and the durability test was conducted under the conditions similar to those in Example 1. However, the moving speed of the light receiving member was 200 mm/sec and the blade 421 used was a silicone rubber blade having the modulus of repulsion elasticity of 35%. The wear losses of the surface layers after this durability test are shown in Table 16.

Further, the results of evaluation for uneven scraping, fusion and cleaning failure made in the same manner as in Example 1 are shown in Table 17, and the results of evaluation for image smearing are shown in Table 18.

As is seen from these tables, neither of the light receiving members 1G to 1I experienced the image defect of the linear pattern caused by the uneven scraping even after the durability test of 100,000 sheets and the image defect due to cleaning failure, fusion, or the like at all. Further, concerning the image smearing, good image characteristics were obtained without provision of the heating means of the light receiving member.

Comparative Example 3

In the similar fashion to Example 3, using the plasma CVD apparatus illustrated in FIG. 3, the light receiving members IG', 1H', 1I' were produced by stacking the lower inhibiting layer, charge transport layer and charge generating layer on the cylindrical conductive substrate under the conditions of Table 14 and thereafter depositing the surface layer in a thickness of 0.5 $\mu$m under the conditions of Table 19.

Separately, a-C:F surface layer samples of 1G' to 1I' were each prepared on the 7059 glass substrate under the conditions of Table 19, and the fluorine contents and dynamic hardness of the surface layers of 1G' to 1I' were measured by the similar method to that in Example 1.

As a result, the fluorine contents and dynamic hardness of the surface layers of the light receiving members 1G' to 1I' were the values shown in Table 20.

Next, each of these light receiving members 1G' to 1I' was mounted in the modified machine from the copying machine NP-6085 manufacture by CANON K. K., and the durability test was conducted under the conditions similar to those in Example 1. However, the moving speed of the light receiving member was 200 mm/sec and the blade 421 used was a silicone rubber blade having the modulus of repulsion elasticity of 8%. The wear losses of the surface layers after this durability test are shown in Table 20.

Further, the results of evaluation for uneven scraping, fusion and cleaning failure made in the same manner as in Example 1 are shown in Table 21, and the results of evaluation for image smearing are shown in Table 22.

As is seen from the tables, in the case of the a-C:F films where the wear loss was greater than 100 Å/10,000 sheets, the fusion and image smearing were of the practically acceptable level after the durability test of 100,000 sheets, but they had low mechanical strength and thus sometimes showed occurrence of image defects of uneven scraping or scratches in a white line pattern.

Example 4

In the similar fashion to Example 3, using the plasma CVD apparatus illustrated in FIG. 3, the light receiving members 1J, 1K, 1L were each produced by stacking the lower inhibiting layer, charge transport and charge generating layer on the cylindrical conductive substrate under the conditions of Table 14 and thereafter depositing the surface layer in a thickness of 0.5 $\mu$m under the conditions of Table 23.

Separately, a-C:F surface layer samples of 1J to 1L were each prepared on the 7059 glass substrate under the conditions of Table 23, and the fluorine contents and dynamic hardness of the surface layers of 1J to 1L were measured by the similar method to that in Example 1.

As a result, the fluorine contents and dynamic hardness of the surface layers of the light receiving members 1J to 1L were the values shown in Table 24.

Next, each of these light receiving members 1J to 1L was mounted in the modified machine from the copying machine NP-6085 manufacture by CANON K. K., and the durability test was conducted under the conditions similar to those in Example 1. However, the moving speed of the light receiving member was 500 mm/sec and the blade 421 used was a silicone rubber blade having the modulus of repulsion elasticity of 50%. The wear losses of the surface layers after this durability test are shown in Table 24.

Further, the results of evaluation for uneven scraping, fusion and cleaning failure made in the same manner as in Example 1 are shown in Table 17, and the results of evaluation for image smearing are shown in Table 18.

As is seen from these tables, neither of the light receiving members 1J to 1L experienced the image defect of the linear pattern caused by the uneven scraping even after the durability test of 100,000 sheets and the image defect due to cleaning failure, fusion, or the like at all. Further, concerning the image smearing, good image characteristics were obtained without provision of the heating means of the light receiving member.

Comparative Example 4

In the similar fashion to Example 3, using the plasma CVD apparatus illustrated in FIG. 3, the light receiving members 1J', 1K', 1L' were produced by stacking the lower inhibiting layer, charge transport layer and charge generating layer on the cylindrical conductive substrate under the conditions of Table 14 and thereafter depositing the surface layer in a thickness of 0.5 μm under the conditions of Table 25.

Separately, a-C:F surface layer samples of 1J' to 1L' were each prepared on the 7059 glass substrate under the conditions of Table 25, and the fluorine contents and dynamic hardness of the surface layers of 1J' to 1L' were measured by the similar method to that in Example 1.

As a result, the fluorine contents and dynamic hardness of the surface layers of the light receiving members 1J' to 1L' were the values shown in Table 26.

Next, each of these light receiving members 1J' to 1L' was mounted in the modified machine from the copying machine NP-6085 manufacture by CANON K. K., and the durability test was conducted under the conditions similar to those in Example 1. However, the moving speed of the light receiving member was 500 mm/sec and the blade 421 used was a silicone rubber blade having the modulus of repulsion elasticity of 55%. The wear losses of the surface layers after this durability test are shown in Table 26.

Further, the results of evaluation for uneven scraping, fusion and cleaning failure made in the same manner as in Example 1 are shown in Table 21, and the results of evaluation for image smearing are shown in Table 22.

As is seen from the tables, in the case of the a-C:F films where the wear loss was smaller than 0.1 Å/10,000 sheets, there were cases where the fusion and image smearing occurred by the durability test of 100,000 sheets.

Example 5

Using the plasma CVD apparatus illustrated in FIG. 2, a light receiving member was produced by stacking the lower inhibiting layer and the photoconductive layer on the cylindrical conductive substrate under the conditions of Table 27 and thereafter depositing the surface layer in a thickness of 0.5 μm under the conditions of the inner pressure 2F of Table 28.

Separately, a surface layer was deposited in a thickness of 0.5 μm under the conditions of the inner pressure 2F of Table 28 on a 7059 glass substrate (mfd. by Corning Glassworks) to prepare an a-C:F surface layer sample, as a sample for measuring the fluorine content of the surface layer.

With the surface layer sample, the fluorine content F/(C+F) was measured by the ESCA analysis in the same manner as in Example 1 to obtain a fluorine content of 50 atomic %. Further, the dynamic hardness was measured using a dynamic ultrafine hardness meter (trade name: DUH-201, mfd. by Shimadzu Corp.). The dynamic hardness was represented by the value obtained when an indenter of a triangular pyramid having a radius of curvature of tip of not more than 0.1 μm and an edge-to-edge angle of 115° was used and the indenter was forced into the sample until a 0.1 gf load was attained, so that a value of 10 kgf/mm$^2$ was obtained.

Then, the light receiving member was mounted in a modified machine from the copying machine NP-6085 manufacture by CANON K. K. and was evaluated as to the wear unevenness of the surface layer by a durability test of continuous passage of A4-size transfer sheets in the same manner as in Example 1 at the moving speed of the light receiving member of 400 mm/sec. The cleaning roller 426 shown in FIG. 5 used herein was a magnet roller and the elastic rubber blade 421 used was an urethane rubber blade having the modulus of repulsion elasticity of 10%. Further, in order to promote the wearing, the additive used for the developer was added excessively by 10%.

The method of evaluation for wear unevenness is described below with reference to FIG. 5.

The charging current of the primary charger 402 is adjusted so that the dark area potential of the light receiving member 401 is 400 V at the position of the developing device 404. An original 412 having solid black vertical lines and solid white lines is placed on the original plate 411. Providing in the direction of the generating line of the surface of the light receiving member a portion at which the developer always intervenes and another portion at which the developer does not intervene results in provision of a portion rubbed with the developer and another portion not rubbed therewith. When the thickness at the solid white portion of the surface layer of the light receiving member has been reduced by wearing to 50% of the initial thickness thereof, the difference thereof from the thickness at the solid black portion of the surface layer is measured and the difference is defined as the wear unevenness.

The wear losses of the surface layer after the durability test were measured by a reflection spectroscopic interferometer according to the above mentioned evaluation method with the result that the difference in thickness between the portions of the surface layer corresponding to the solid white and the solid black portions was 2%.

Example 6

When a light receiving member was produced and evaluated for the wear unevenness by following the procedure of Example 5 with the exception that the cleaner 425 shown in FIG. 5 was provided only with the blade 421 without provision of the cleaning roller 426, the value of the thickness difference of 10% was obtained.

It is seen from the results of Examples 5 and 6 above that as compared with the configuration not using the rolling contact means such as a cleaning roller in the electrophotographic process, the configuration using the rolling contact means in the electrophotographic process more effectively suppressed the occurrence of wear unevenness to allow the surface layer to wear more uniformly.

Example 7

Using the plasma CVD apparatus illustrated in FIG. 2, the light receiving members 2A, 2B, 2C were each produced by stacking the lower inhibiting layer and the photoconductive layer on the cylindrical conductive substrate under the conditions of Table 27 and thereafter depositing the surface layer in a thickness of 0.5 μm under the conditions of Table 29.

Separately, surface layers were deposited in a thickness of 0.5 μm under the conditions of Table 29 on the 7059 glass substrates to prepare a-C:F surface layer samples 2A–2C, as samples for measuring the fluorine content of the surface layer.

The fluorine contents and dynamic hardness of the surface layers of the light receiving members 2A to 2C were measured by the similar method to that in Example 5 to obtain the values shown in Table 30.

Next, each of these light receiving members 2A to 2C was mounted in the modified machine from the copying machine NP-6085 manufacture by CANON K. K. and was evaluated for the cleaning property by a durability test of continuous passage of 100,000 A4-size transfer sheets at the moving speed of the light receiving member 401 of 200 mm/sec. The cleaning roller 426 used was a magnet roller and the elastic rubber blade 421 used was an urethane rubber blade having the modulus of repulsion elasticity of 10%. The developing agent used was one having the average grain diameter of 6.5 μm, because the fusion was likely to occur with smaller grain diameters of the developer. Further, the temperature of the surface of the light receiving member was controlled to 60° C. to obtain the condition under which the fusion became easier to occur.

The wear losses of the surface layers after the durability test are shown in Table 30. The wear losses of the surface layers were obtained by measuring the thicknesses of the surface layers before and after the durability test by a reflection spectroscopic interferometer and calculating the wear losses per 10,000 sheets from these values.

Further, the light receiving members of 2A to 2C were evaluated as to the image smearing by carrying out the durability test of 100,000 sheets under the environment of 35° C. and relative humidity 90% without provision of the heating means. The cleaning roller 426 used was a magnet roller and the elastic rubber blade 421 used was an urethane rubber blade having the modulus of repulsion elasticity of 10% and the cleaning conditions were so set as to effect such scrape cleaning that the urging pressure of the blade was 50% of the ordinary pressure.

The results of the evaluation of smearing image are shown in Table 31.

Further, the results of evaluation made in the same manner as in Example 1 are shown in Table 32.

As is seen from Table 32, the light receiving members 2A, 2B, 2C had neither the image defect of the black line pattern caused by the uneven scraping even after the durability test of 100,000 sheets nor the image defects due to cleaning failure, fusion, and the like at all. Further, concerning the image smearing, good image characteristics were obtained without provision of the heating means for the light receiving member.

Further, the edge portion of the urethane rubber blade after the durability test was observed by a metallurgical microscope with the result that any break such as flaw or the like was not recognized and the initial state was maintained.

Comparative Example 5

In the similar fashion to Example 5, using the plasma CVD apparatus illustrated in FIG. 2, the light receiving members 2A', 2B', 2C' were each produced by stacking the lower inhibiting layer and the photoconductive layer on the cylindrical conductive substrate under the conditions of Table 27 and thereafter depositing the surface layer in a thickness of 0.5 μm under the conditions of Table 33. Separately, a-C:F surface layer samples of 2A' to 2C' were each prepared on the 7059 glass substrate under the conditions of Table 33, and the fluorine contents and dynamic hardness of the surface layers of 2A' to 2C' were measured by the similar method to that in Example 5.

As a result, the fluorine contents and dynamic hardness of the surface layers of the light receiving members 2A' to 2C' were the values shown in Table 34.

Next, each of these light receiving members 2A' to 2C' was mounted in the modified machine from the copying machine NP-6085 manufacture by CANON K. K., and the durability test was conducted under the conditions similar to those in Example 7. However, the cleaning roller 426 used was a magnet roller, the moving speed of the light receiving member 401 was 200 mm/sec, and the blade 421 used was an urethane rubber blade having the modulus of repulsion elasticity of 8%. The wear losses of the surface layers after this durability test are shown in Table 34.

Further, the results of evaluation for uneven scraping, fusion and cleaning failure made in the same manner as in Example 7 are shown in Table 35, and the results of evaluation for image smearing are shown in table 36.

As is seen from the tables, fusion and cleaning failure occurred by the durability test of 100,000 sheets. Further, the image smearing was evaluated by the durability test under the conditions without provision of the heating means for the light receiving member with the result that image smearing sometimes occurred.

Further, the edge portion of the urethane rubber blade after the durability test was observed by a metallurgical microscope with the result that breaks such as flaw or the like were recognized.

Example 8

In the similar fashion to Example 5, using the plasma CVD apparatus illustrated in FIG. 2, the light receiving members 2D, 2E, 2F were each produced by stacking the lower inhibiting layer and the photoconductive layer on the cylindrical conductive substrate under the conditions of Table 27 and thereafter depositing the surface layer in a thickness of 0.5 μm under the conditions of Table 28. Separately, a-C:F surface layer samples of 2D to 2F were each prepared on the 7059 glass substrate under the conditions of Table 28, and the fluorine contents and dynamic hardness of the surface layers of 2D to 2F were measured by the similar method to that in Example 5.

As a result, the fluorine contents and dynamic hardness of the surface layers of the light receiving members 2D to 2F were the values shown in Table 37.

Next, each of these light receiving members 2D to 2F was mounted in the modified machine from the copying machine NP-6085 manufacture by CANON K. K., and the durability test was conducted under the conditions similar to those in Example 7. However, the cleaning roller 426 used was a roller of expanded polyurethane, the moving speed of the light receiving member 401 was 300 mm/sec, and the blade 421 used was an urethane rubber blade having the modulus of repulsion elasticity of 25%. The wear losses of the surface layers after this durability test are shown in Table 37.

Further, the results of evaluation for uneven scraping, fusion and cleaning failure made in the same manner as in Example 7 are shown in Table 32.

Further, the light receiving members of 2D to 2F were evaluated as to the image smearing by carrying out the durability test of 100,000 sheets under the environment of 35° C. and relative humidity 90% without provision of the heating means. The cleaning roller 426 used was a roller of expanded polyurethane and the elastic rubber blade 421 used was an urethane rubber blade having the modulus of repulsion elasticity of 10% and the cleaning conditions were so set as to effect such scrape cleaning that the urging pressure of the blade was 50% of the ordinary pressure. The results of the evaluation of smearing image are shown in Table 31.

As is seen from the tables, the light receiving members 2D, 2E, 2F had neither the image defect of the line pattern caused by the uneven scraping even after the durability test of 100,000 sheets nor the image defects due to cleaning failure, fusion, and the like at all. Further, concerning the image smearing, good image characteristics were obtained without provision of the heating means for the light receiving member.

Further, the edge portion of the urethane rubber blade after the durability test was observed by a metallurgical microscope with the result that any break such as flaw or the like was not recognized and the initial state was maintained.

Comparative Example 6

In the similar fashion to Example 5, using the plasma CVD apparatus illustrated in FIG. 2, the light receiving members 2D', 2E', 2F' were each produced by stacking the lower inhibiting layer and the photoconductive layer on the cylindrical conductive substrate under the conditions of Table 27 and thereafter depositing the surface layer in a thickness of 0.5 μm under the conditions of Table 38.

Separately, a-C:F surface layer samples of 2D' to 2F' were each prepared on the 7059 glass substrate under the conditions of Table 38, and the fluorine contents and dynamic hardness of the surface layers of 2D' to 2F' were measured by the similar method to that in Example 5. As a result, the fluorine contents and dynamic hardness of the surface layers of the light receiving members 2D' to 2F' were the values shown in Table 39.

Next, each of these light receiving members 2D' to 2F' was mounted in the modified machine from the copying machine NP-6085 manufacture by CANON K. K., and the durability test was conducted under the conditions similar to those in Example 7. However, the cleaning roller 426 used was a silicone rubber roller, the moving speed of the light receiving member 401 was 300 mm/sec, and the blade 421 used was an urethane rubber blade having the modulus of repulsion elasticity of 5%. The wear losses of the surface layers after this durability test are shown in Table 39.

Further, the results of evaluation for uneven scraping, fusion and cleaning failure made in the same manner as in Example 7 are shown in Table 35, and the results of evaluation for image smearing are shown in table 36.

As is seen from the tables, although the fusion and the image smearing were of the practically acceptable level, there were cases where image defects in a liner pattern due to scratches and uneven scraping occurred by the durability test of 100,000 sheets.

Further, the edge portion of the urethane rubber blade after the durability test was observed by a metallurgical microscope with the result that breaks such as flaw or the like were recognized.

Example 9

In the similar fashion to Example 5, using the plasma CVD apparatus illustrated in FIG. 3, the light receiving members 2G, 2H, 2I were produced by stacking the lower inhibiting layer, charge transport layer and charge generating layer on the cylindrical conductive substrate under the conditions of Table 40 and thereafter depositing the surface layer in a thickness of 0.5 μm under the conditions of Table 41.

Separately, a-C:F surface layer samples of 2G to 2I were each prepared on the 7059 glass substrate under the conditions of Table 41, and the fluorine contents and dynamic hardness of the surface layers of 2G to 2I were measured by the similar method to that in Example 5.

As a result, the fluorine contents and dynamic hardness of the surface layers of the light receiving members 2G to 2I were the values shown in Table 42.

Next, each of these light receiving members 2G to 2I was mounted in the modified machine from the copying machine NP-6085 manufacture by CANON K. K., and the durability test was conducted under the conditions similar to those in Example 7. However, the cleaning roller 426 used was a magnet roller. Further, the primary charger 402 and the separation charger 407 were constituted of silicone rubber roller charging and roller transfer. In addition, the moving speed of the light receiving member 401 was 100 mm/sec and the blade 421 used was a silicon rubber blade having the modulus of repulsion elasticity of 35%. The wear losses of the surface layers after this durability test are shown in Table 42.

Further, the results of evaluation for uneven scraping, fusion and cleaning failure made in the same manner as in Example 7 are shown in Table 43, and the results of evaluation for image smearing are shown in Table 44.

As is seen from these tables, neither of the light receiving members 2G to 2I experienced the image defect of the linear pattern caused by the uneven scraping even after the durability test of 100,000 sheets and the image defect due to cleaning failure, fusion, or the like at all. Further, concerning the image smearing, good image characteristics were obtained without provision of the heating means of the light receiving member.

Further, the edge portion of the silicone rubber blade after the durability test was observed by a metallurgical microscope with the result that any break such as flaw or the like was not recognized and the initial state was maintained.

Comparative Example 7

In the similar fashion to Example 9, using the plasma CVD apparatus illustrated in FIG. 3, the light receiving members 2G', 2H', 2I' were each produced by stacking the lower inhibiting layer, charge transport layer and charge generation layer on the cylindrical conductive substrate under the conditions of Table 40 and thereafter depositing the surface layer in a thickness of 0.5 μm under the conditions of Table 45.

Separately, a-C:F surface layer samples of 2G' to 2I' were each prepared on the 7059 glass substrate under the conditions of Table 45, and the fluorine contents and dynamic hardness of the surface layers of 2G' to 2I' were measured by the similar method to that in Example 5.

As a result, the fluorine contents and dynamic hardness of the surface layers of the light receiving members 2G' to 2I' were the values shown in Table 46.

Next, each of these light receiving members 2G' to 2I' was mounted in the modified machine from the copying machine NP-6085 manufacture by CANON K. K., and the durability test was conducted under the conditions similar to those in Example 7. However, the cleaning roller 426 used was a magnet roller, and the primary charger 402 and the separation charger 407 were constituted of silicone rubber roller charging and roller transfer. Further, the moving speed of the light receiving member 401 was 100 mm/sec, and the blade 421 used was a silicone rubber blade having the modulus of repulsion elasticity of 8%. The wear losses of the surface layers after this durability test are shown in Table 46.

Further, the results of evaluation for uneven scraping, fusion and cleaning failure made in the same manner as in Example 7 are shown in Table 47, and the results of evaluation for image smearing are shown in table 48.

As is seen from the tables, in the case of the a-C:F films where the wear loss was greater than 100 Å/10,000 sheets, the fusion and image smearing were of the practically acceptable level after the durability test of 100,000 sheets, but they had low mechanical strength and thus sometimes showed occurrence of image defects of uneven scraping or scratches in a white line pattern.

Further, the edge portion of the urethane rubber blade after the durability test was observed by a metallurgical microscope with the result that breaks such as flaw or the like were recognized.

Example 10

In the similar fashion to Example 9, using the plasma CVD apparatus illustrated in FIG. 3, the light receiving members 2J, 2K, 2L were produced by stacking the lower inhibiting layer, charge transport layer and charge generating layer on the cylindrical conductive substrate under the conditions of Table 40 and thereafter depositing the surface layer in a thickness of 0.5 $\mu$m under the conditions of Table 49.

Separately, a-C:F surface layer samples of 2J to 2L were each prepared on the 7059 glass substrate under the conditions of Table 49, and the fluorine contents and dynamic hardness of the surface layers of 2J to 2L were measured by the similar method to that in Example 5.

As a result, the fluorine contents and dynamic hardness of the surface layers of the light receiving members 2J to 2L were the values shown in Table 50.

Next, each of these light receiving members 2J to 2L was mounted in the modified machine from the copying machine NP-6085 manufacture by CANON K. K., and the durability test was conducted under the conditions similar to those in Example 7. However, the cleaning roller 426 used was an urethane rubber roller, and the primary charger 402 and the separation charger 407 were constituted of urethane rubber roller charging and roller transfer. Further, the moving speed of the light receiving member 401 was 400 mm/sec and the blade 421 used was a silicon rubber blade having the modulus of repulsion elasticity of 50%. The wear losses of the surface layers after this durability test are shown in Table 50.

Further, the results of evaluation for uneven scraping, fusion and cleaning failure made in the same manner as in Example 7 are shown in Table 51, and the results of evaluation for image smearing are shown in Table 52.

As is seen from these tables, neither of the light receiving members 2J to 2L experienced the image defect of the linear pattern caused by the uneven scraping even after the durability test of 100,000 sheets and the image defect due to cleaning failure, fusion, or the like at all. Further, concerning the image smearing, good image characteristics were obtained without provision of the heating means of the light receiving member.

Further, the edge portion of the silicone rubber blade after the durability test was observed by a metallurgical microscope with the result that any break such as flaw or the like was not recognized and the initial state was maintained.

Comparative Example 8

In the similar fashion to Example 9, using the plasma CVD apparatus illustrated in FIG. 3, the light receiving members 2J', 2K', 2L' were each produced by stacking the lower inhibiting layer, charge transport layer and charge generation layer on the cylindrical conductive substrate under the conditions of Table 40 and thereafter depositing the surface layer in a thickness of 0.5 $\mu$m under the conditions of Table 51.

Separately, a-C:F surface layer samples of 2J' to 2L' were each prepared on the 7059 glass substrate under the conditions of Table 51, and the fluorine contents and dynamic hardness of the surface layers of 2J' to 2L' were measured by the similar method to that in Example 7.

As a result, the fluorine contents and dynamic hardness of the surface layers of the light receiving members 2J' to 2L' were the values shown in Table 52.

Next, each of these light receiving members 2J' to 2L' was mounted in the modified machine from the copying machine NP-6085 manufacture by CANON K. K., and the durability test was conducted under the conditions similar to those in Example 7. However, the cleaning roller 426 used was a silicone rubber roller, and the primary charger 402 and the separation charger 407 were constituted of urethane rubber roller charging and roller transfer. Further, the moving speed of the light receiving member was 400 mm/sec and the blade 421 used was a silicone rubber blade having the modulus of repulsion elasticity of 55%. The wear losses of the surface layers after this durability test are shown in Table 52.

Further, the results of evaluation for uneven scraping, fusion and cleaning failure made in the same manner as in Example 7 are shown in Table 47, and the results of evaluation for image smearing are shown in Table 48.

As is seen from the tables, in the case of the a-C:F films where the wear loss was smaller than 0.1 Å/10,000 sheets, there were cases where the cleaning failure and image smearing occurred by the durability test of 100,000 sheets.

Further, the edge portion of the silicone rubber blade after the durability test was observed by a metallurgical microscope with the result that breaks such as flaw or the like were recognized.

In Tables 4, 9, 18, 22, 31, 36, 44 and 48, in each, the phrase "a: Good image without image smearing" means that images in a density of seven lines/mm can be seen.

TECHNICAL EFFECT

As described above, according to the present invention, it is possible to solve the problem due to the wearing of the surface of the surface layer and to solve the problem due to the adhesion of undesired substance to the surface such as fusion of the developer.

In addition, according to the present invention, it is possible to solve the problem due to the image smearing without provision of the heating means, whereby further energy saving, further cost reduction, less necessity of maintenance, further size reduction, and so on can be accomplished.

Moreover, according to the present invention, in the electrophotographic apparatus having the structure for scrape-cleaning the developer of the average particle diameter of 5 to 8 μm with the elastic rubber blade having the modulus of repulsion elasticity of not less than 10% nor more than 50%, by using the light receiving member having the surface layer comprised of the non-monocrystalline fluorinated carbon film in which the wear loss after copying steps of 10,000 A4-size transfer sheets was not less than 0.1 Å nor more than 100 Å, in which the fluorine content was not less than 5 atomic % nor more than 50 atomic %, and in which the dynamic hardness is within the range of 10 to 500 kgf/mm$^2$, it has become possible to allow the surface layer to uniformly wear and also to prevent the image density irregularities caused by the uneven scraping and the fusion of the developer.

In addition, by allowing the surface layer to uniformly wear within the range of not less than 0.1 Å/10,000 transfer sheets nor more than 100 Å/10,000 transfer sheets, it is possible to effectively prevent the image defect such as the image smearing even under any service environments without provision of the means for directly heating the surface of the light receiving member.

Further, the present invention has enabled to remarkably extend the latitude of design of the electrophotographic apparatus, including the types of developers that can be used, size reduction of the electrophotographic apparatus, reduction of cost, and so on.

The present invention involves all modifications and combinations falling in the scope of the spirit of the invention and it is needless to mention that the present invention is not limited to only the above-stated examples.

TABLE 1

| Production Conditions for Light Receiving Members | | |
|---|---|---|
| Lower Inhibiting Layer | Source Gases and Introducing Amount | |
| | $SiH_4$ | 300 sccm |
| | $H_2$ | 500 sccm |
| | NO | 8 sccm |
| | $B_2H_6$ | 2000 ppm |
| | Power | 100 W (13.56 MHz) |
| | Inner Pressure | 53.2 Pa |
| | Thickness | 1 μm |
| Photoconductive layer | Source Gases and Introducing Amount | |
| | $SiH_4$ | 500 sccm |
| | $H_2$ | 500 sccm |
| | Power | 400 W (13.56 MHz) |
| | Inner Pressure | 66.5 Pa |
| | Thickness | 20 μm |

TABLE 2

| Production Conditions for Surface Layers in Example 1 | |
|---|---|
| $C_2F_6/CH_4$ | 40 sccm/40 sccm |
| Inner Pressure (1A) | 13.3 Pa |
| Inner Pressure (1B) | 20.0 Pa |
| Inner Pressure (1C) | 26.6 Pa |
| Temperature | 300° C. |
| Power | 400 W (13.56 MHz) |

TABLE 3

| Light Receiving Member | Wear Loss (Å/10,000 sheets) | Fluorine Content (%) | Dynamic Hardness (kgf/mm$^2$) |
|---|---|---|---|
| 1A | 0.1 | 5 | 500 |
| 1B | 1 | 20 | 350 |
| 1C | 10 | 30 | 200 |

TABLE 4

| Light Receiving Member | 10,000 sheets | 30,000 sheets | 50,000 sheets | 80,000 sheets | 100,000 sheets |
|---|---|---|---|---|---|
| 1A | a | a | a | a | a |
| 1B | a | a | a | a | a |
| 1C | a | a | a | a | a |
| 1D | a | a | a | a | a |
| 1E | a | a | a | a | a |
| 1F | a | a | a | a | a |

a: Good image without image smearing
b: Image in such a practically acceptable level that lines in the density of 7 lines/mm are not seen but lines in the density of 6 lines/mm are seen
c: Image possibly having image smearing in such a level that lines in the density of 5 lines/mm are not seen

TABLE 5

| Light Receiving Member | Uneven Scraping | Fusion | Cleaning Failure |
|---|---|---|---|
| 1A | a | a | a |
| 1B | a | a | a |
| 1C | a | a | a |
| 1D | a | a | a |
| 1E | a | a | a |
| 1F | a | a | a |

TABLE 6

| Production Conditions for Surface Layers in Comparative Example 1 | |
|---|---|
| $C_2F_6/CH_4$ | 10 sccm/120 sccm |
| Power (1A') | 1000 W (13.56 MHz) |
| Power (1B') | 800 W (13.56 MHz) |
| Power (1C') | 500 W (13.56 MHz) |
| Temperature | 200° C. |
| Inner Pressure | 26.6 Pa |

TABLE 7

| Light Receiving Member | Wear Loss (Å/10,000 sheets) | Fluorine Content (%) | Dynamic Hardness (kgf/mm$^2$) |
|---|---|---|---|
| 1A' | 0.03 | 0.5 | 800 |
| 1B' | 0.05 | 1.0 | 700 |
| 1C' | 0.09 | 4.0 | 550 |

TABLE 8

| Light Receiving Member | Uneven Scraping | Fusion | Cleaning Failure |
|---|---|---|---|
| 1A' | b | c | c |
| 1B' | b | c | c |
| 1C' | b | c | c |
| 1D' | c | a | c |

TABLE 8-continued

| Light Receiving Member | Uneven Scraping | Fusion | Cleaning Failure |
|---|---|---|---|
| 1E' | c | a | c |
| 1F' | c | a | c |

TABLE 9

| Light Receiving Member | 10,000 sheets | 30,000 sheets | 50,000 sheets | 80,000 sheets | 100,000 sheets |
|---|---|---|---|---|---|
| 1A' | a | b | c | c | c |
| 1B' | a | b | b | c | c |
| 1C' | a | a | b | b | c |
| 1D' | a | a | a | a | a |
| 1E' | a | a | a | a | a |
| 1F' | a | a | a | a | a |

a: Good image without image smearing
b: Image in such a practically acceptable level that lines in the density of 7 lines/mm are not seen but lines in the density of 6 lines/mm are seen
c: Image having image smearing in such a level that lines in the density of 5 lines/mm are not seen

TABLE 10

Production Conditions for Surface Layers in Example 2

| $C_2F_6/H_2$ | 40 sccm/40 sccm |
|---|---|
| Inner Pressure (1D) | 66.5 Pa |
| Inner Pressure (1E) | 79.8 Pa |
| Inner Pressure (1F) | 93.1 Pa |
| Temperature | 100° C. |
| Power | 200 W (13.56 MHz) |

TABLE 11

| Light Receiving Member | Wear Loss (Å/10,000 sheets) | Fluorine Content (%) | Dynamic Hardness (kgf/mm$^2$) |
|---|---|---|---|
| 1D | 70 | 40 | 100 |
| 1E | 85 | 45 | 50 |
| 1F | 100 | 50 | 10 |

TABLE 12

Production Conditions for Surface Layers in Comparative Example 2

| $C_2F_6/H_2$ | 120 sccm/40 sccm |
|---|---|
| Inner Pressure (1D') | 66.5 Pa |
| Inner Pressure (1E') | 79.8 Pa |
| Inner Pressure (1F') | 93.1 Pa |
| Temperature | 100° C. |
| Power | 200 W (13.56 MHz) |

TABLE 13

| Light Receiving Member | Wear Loss (Å/10,000 sheets) | Fluorine Content (%) | Dynamic Hardness (kgf/mm$^2$) |
|---|---|---|---|
| 1D' | 130 | 55 | 8 |
| 1E' | 160 | 65 | 5 |
| 1F' | 200 | 73 | 3 |

TABLE 14

Production Conditions for Light Receiving Members

| | | |
|---|---|---|
| Lower Inhibiting Layer | Source Gases and Introducing Amount | |
| | $SiH_4$ | 300 sccm |
| | $H_2$ | 500 sccm |
| | $B_2H_6$ | 2000 ppm |
| | Power | 100 W (105 MHz) |
| | Inner Pressure | 26.6 Pa |
| | Thickness | 1 μm |
| Charge Transport Layer | Source Gases and Introducing Amount | |
| | $SiH_4$ | 500 sccm |
| | $H_2$ | 500 sccm |
| | $CH_4$ | 50 sccm |
| | Power | 300 W (105 MHz) |
| | Inner Pressure | 26.6 Pa |
| | Thickness | 15 μm |
| Charge generating layer | Source Gases and Introducing Amount | |
| | $SiH_4$ | 500 sccm |
| | $H_2$ | 500 sccm |
| | Power | 300 W (105 MHz) |
| | Inner Pressure | 26.6 Pa |
| | Thickness | 5 μm |

TABLE 15

Production Conditions for Surface Layers in Example 3

| $C_2F_6/CH_4$ | 120 sccm/120 sccm |
|---|---|
| Inner Pressure (1G) | 66.5 Pa |
| Inner Pressure (1H) | 79.8 Pa |
| Inner Pressure (1I) | 93.1 Pa |
| Temperature | 200° C. |
| Power | 400 W (105 MHz) |

TABLE 16

| Light Receiving Member | Wear Loss (Å/10,000 sheets) | Fluorine Content (%) | Dynamic Hardness (kgf/mm$^2$) |
|---|---|---|---|
| 1G | 45 | 37 | 150 |
| 1H | 75 | 43 | 80 |
| 1I | 90 | 48 | 20 |

TABLE 17

| Light Receiving Member | Uneven Scraping | Fusion | Cleaning Failure |
|---|---|---|---|
| 1G | a | a | a |
| 1H | a | a | a |
| 1I | a | a | a |
| 1J | a | a | a |
| 1K | a | a | a |
| 1L | a | a | a |

TABLE 18

| Light Receiving Member | 10,000 sheets | 30,000 sheets | 50,000 sheets | 80,000 sheets | 100,000 sheets |
|---|---|---|---|---|---|
| 1G | a | a | a | a | a |
| 1H | a | a | a | a | a |
| 1I | a | a | a | a | a |
| 1J | a | a | a | a | a |

TABLE 18-continued

| Light Receiving Member | 10,000 sheets | 30,000 sheets | 50,000 sheets | 80,000 sheets | 100,000 sheets |
|---|---|---|---|---|---|
| 1K | a | a | a | a | a |
| 1L | a | a | a | a | a |

a: Good image without image smearing b: Image in such a practically acceptable level that lines in the density of 7 lines/mm are not seen but lines in the density of 6 lines/mm are seen c: Image having image smearing in such a level that lines in the density of 5 lines/mm are not seen

TABLE 19

| Production Conditions for Surface Layers in Comparative Example 3 | |
|---|---|
| $C_2F_6/H_2$ | 40 sccm/5 sccm |
| Inner Pressure (1G') | 2.7 Pa |
| Inner Pressure (1H') | 13.3 Pa |
| Inner Pressure (1I') | 20.0 Pa |
| Temperature | 200° C. |
| Power | 400 W (105 MHz) |

TABLE 20

| Light Receiving Member | Wear Loss (Å/10,000 sheets) | Fluorine Content (%) | Dynamic Hardness (kgf/mm$^2$) |
|---|---|---|---|
| 1G' | 120 | 53 | 9 |
| 1H' | 150 | 60 | 7 |
| 1I' | 180 | 70 | 4 |

TABLE 21

| Light Receiving Member | Uneven Scraping | Fusion | Cleaning Failure |
|---|---|---|---|
| 1G' | c | a | c |
| 1H' | c | a | c |
| 1I' | c | a | c |
| 1J' | b | c | c |
| 1K' | b | c | c |
| 1L' | b | c | c |

TABLE 22

| Light Receiving Member | 10,000 sheets | 30,000 sheets | 50,000 sheets | 80,000 sheets | 100,000 sheets |
|---|---|---|---|---|---|
| 1G' | a | a | a | a | a |
| 1H' | a | a | a | a | a |
| 1I' | a | a | a | a | a |
| 1J' | a | b | c | c | c |
| 1K' | a | a | b | c | c |
| 1L' | a | a | a | b | c |

a: Good image without image smearing
b: Image in such a practically acceptable level that lines in the density of 7 lines/mm are not seen but lines in the density of 6 lines/mm are seen
c: Image having image smearing in such a level that lines in the density of 5 lines/mm are not seen

TABLE 23

| Production Conditions for Surface Layers in Example 4 | |
|---|---|
| $C_2F_6/H_2$ | 120 sccm/120 sccm |
| Inner Pressure (1J) | 13.3 Pa |
| Inner Pressure (1K) | 20.0 Pa |
| Inner Pressure (1L) | 26.6 Pa |
| Temperature | 100° C. |
| Power | 200 W (105 MHz) |

TABLE 24

| Light Receiving Member | Wear Loss (Å/10,000 sheets) | Fluorine Content (%) | Dynamic Hardness (kgf/mm$^2$) |
|---|---|---|---|
| 1J | 5 | 10 | 450 |
| 1K | 20 | 23 | 300 |
| 1L | 30 | 35 | 160 |

TABLE 25

| Production Conditions for Surface Layers in Comparative Example 4 | |
|---|---|
| $SiH_4/CH_4$ | 50 sccm/50 sccm |
| Power (1J') | 1000 W (105 MHz) |
| Power (1K') | 800 W (105 MHz) |
| Power (1L') | 500 W (105 MHz) |
| Temperature | 200° C. |
| Inner Pressure | 2.7 Pa |

TABLE 26

| Light Receiving Member | Wear Loss (Å/10,000 sheets) | Fluorine Content (%) | Dynamic Hardness (kgf/mm$^2$) |
|---|---|---|---|
| 1J' | 0.01 | 0.3 | 900 |
| 1K' | 0.04 | 2.0 | 750 |
| 1L' | 0.08 | 3.0 | 600 |

TABLE 27

| Production Conditions for Light Receiving Members | | |
|---|---|---|
| Lower Inhibiting Layer | Source Gases and Introducing Amount | |
| | $SiH_4$ | 300 sccm |
| | $H_2$ | 500 sccm |
| | NO | 8 sccm |
| | $B_2H_6$ | 2000 ppm |
| | Power | 100 W (13.56 MHz) |
| | Inner Pressure | 53.2 Pa |
| | Thickness | 1 μm |
| Photoconductive layer | Source Gases and Introducing Amount | |
| | $SiH_4$ | 500 sccm |
| | $H_2$ | 500 sccm |
| | Power | 400 W (13.56 MHz) |
| | Inner Pressure | 66.5 Pa |
| | Thickness | 20 μm |

TABLE 28

| Production Conditions for Surface Layers | |
|---|---|
| $C_2F_6/H_2$ | 40 sccm/40 sccm |
| Inner Pressure (2D) | 66.5 Pa |
| Inner Pressure (2E) | 79.8 Pa |
| Inner Pressure (2F) | 93.1 Pa |
| Temperature | 100° C. |
| Power | 200 W (13.56 MHz) |

TABLE 29

| Production Conditions for Surface Layers | |
|---|---|
| $C_2F_6/CH_4$ | 40 sccm/40 sccm |
| Inner Pressure (2A) | 13.3 Pa |
| Inner Pressure (2B) | 20.0 Pa |
| Inner Pressure (2C) | 26.6 Pa |
| Temperature | 300° C. |
| Power | 400 W (13.56 MHz) |

TABLE 30

| Light Receiving Member | Wear Loss (Å/10,000 sheets) | Fluorine Content (%) | Dynamic Hardness (kgf/mm$^2$) |
|---|---|---|---|
| 2A | 0.1 | 5 | 500 |
| 2B | 1 | 20 | 350 |
| 2C | 10 | 30 | 200 |

TABLE 31

| Light Receiving Member | 10,000 sheets | 30,000 sheets | 50,000 sheets | 80,000 sheets | 100,000 sheets |
|---|---|---|---|---|---|
| 2A | a | a | a | a | a |
| 2B | a | a | a | a | a |
| 2C | a | a | a | a | a |
| 2D | a | a | a | a | a |
| 2E | a | a | a | a | a |
| 2F | a | a | a | a | a |

a: Good image without image smearing
b: Image in such a practically acceptable level that lines in the density of 7 lines/mm are not seen but lines in the density of 6 lines/mm are seen
c: Image having image smearing in such a level that lines in the density of 5 lines/mm are not seen

TABLE 32

| Light Receiving Member | Uneven Scraping | Fusion | Cleaning Failure |
|---|---|---|---|
| 2A | a | a | a |
| 2B | a | a | a |
| 2C | a | a | a |
| 2D | a | a | a |
| 2E | a | a | a |
| 2F | a | a | a |

TABLE 33

| Production Conditions for Surface Layers in Comparative Example 5 | |
|---|---|
| $C_2F_6/CH_4$ | 10 sccm/120 sccm |
| Power (2A') | 1000 W (13.56 MHz) |
| Power (2B') | 800 W (13.56 MHz) |
| Power (2C') | 500 W (13.56 MHz) |
| Temperature | 200° C. |
| Inner Pressure | 26.6 Pa |

TABLE 34

| Light Receiving Member | Wear Loss (Å/10,000 sheets) | Fluorine Content (%) | Dynamic Hardness (kgf/mm$^2$) |
|---|---|---|---|
| 2A' | 0.03 | 0.5 | 800 |
| 2B' | 0.05 | 1.0 | 700 |
| 2C' | 0.09 | 4.0 | 550 |

TABLE 35

| Light Receiving Member | Uneven Scraping | Fusion | Cleaning Failure |
|---|---|---|---|
| 2A' | b | c | c |
| 2B' | b | c | c |
| 2C' | b | c | c |
| 2D' | c | a | c |
| 2E' | c | a | c |
| 2F' | c | a | c |

TABLE 36

| Light Receiving Member | 10,000 sheets | 30,000 sheets | 50,000 sheets | 80,000 sheets | 100,000 sheets |
|---|---|---|---|---|---|
| 2A' | a | a | b | c | c |
| 2B' | a | a | a | b | c |
| 2C' | a | a | a | a | b |
| 2D' | a | a | a | a | a |
| 2E' | a | a | a | a | a |
| 2F' | a | a | a | a | a |

a: Good image without image smearing
b: Image in such a practically acceptable level that lines in the density of 7 lines/mm are not seen but lines in the density of 6 lines/mm are seen
c: Image having image smearing in such a level that lines in the density of 5 lines/mm are not seen

TABLE 37

| Light Receiving Member | Wear Loss (Å/10,000 sheets) | Fluorine Content (%) | Dynamic Hardness (kgf/mm$^2$) |
|---|---|---|---|
| 2D | 70 | 40 | 100 |
| 2E | 85 | 45 | 50 |
| 2F | 100 | 50 | 10 |

TABLE 38

| Production Conditions for Surface Layers in Comparative Example 6 | |
|---|---|
| $C_2F_6/H_2$ | 120 sccm/40 sccm |
| Inner Pressure (2D') | 66.5 Pa |
| Inner Pressure (2E') | 79.8 Pa |

TABLE 38-continued

| Production Conditions for Surface Layers in Comparative Example 6 | |
|---|---|
| Inner Pressure (2F') | 93.1 Pa |
| Temperature | 100° C. |
| Power | 200 W (13.56 MHz) |

TABLE 39

| Light Receiving Member | Wear Loss (Å/10,000 sheets) | Fluorine Content (%) | Dynamic Hardness (kgf/mm$^2$) |
|---|---|---|---|
| 2D' | 130 | 55 | 8 |
| 2E' | 160 | 65 | 5 |
| 2F' | 200 | 73 | 3 |

TABLE 40

| Production Conditions for Light Receiving Members | | |
|---|---|---|
| Lower Inhibiting Layer | Source Gases and Introducing Amount | |
| | $SiH_4$ | 300 sccm |
| | $H_2$ | 500 sccm |
| | $B_2H_6$ | 2000 ppm |
| | Power | 100 W (105 MHz) |
| | Inner Pressure | 26.6 Pa |
| | Thickness | 1 μm |
| Charge Transport Layer | Source Gases and Introducing Amount | |
| | $SiH_4$ | 500 sccm |
| | $H_2$ | 500 sccm |
| | $CH_4$ | 50 sccm |
| | Power | 300 W (105 MHz) |
| | Inner Pressure | 26.6 Pa |
| | Thickness | 15 μm |
| Charge generating layer | Source Gases and Introducing Amount | |
| | $SiH_4$ | 500 sccm |
| | $H_2$ | 500 sccm |
| | Power | 300 W (105 MHz) |
| | Inner Pressure | 26.6 Pa |
| | Thickness | 5 μm |

TABLE 41

| Production Conditions for Surface Layers in Example 9 | |
|---|---|
| $C_2F_6/CH_4$ | 120 sccm/120 sccm |
| Inner Pressure (2G) | 66.5 Pa |
| Inner Pressure (2H) | 79.8 Pa |
| Inner Pressure (2I) | 93.1 Pa |
| Temperature | 200° C. |
| Power | 400 W (105 MHz) |

TABLE 42

| Light Receiving Member | Wear Loss (Å/10,000 sheets) | Fluorine Content (%) | Dynamic Hardness (kgf/mm$^2$) |
|---|---|---|---|
| 2G | 45 | 37 | 150 |
| 2H | 75 | 43 | 80 |
| 2I | 90 | 48 | 20 |

TABLE 43

| Light Receiving Member | Uneven Scraping | Fusion | Cleaning Failure |
|---|---|---|---|
| 2G | a | a | a |
| 2H | a | a | a |
| 2I | a | a | a |
| 2J | a | a | a |
| 2K | a | a | a |
| 2L | a | a | a |

TABLE 44

| Light Receiving Member | 10,000 sheets | 30,000 sheets | 50,000 sheets | 80,000 sheets | 100,000 sheets |
|---|---|---|---|---|---|
| 2G | a | a | a | a | a |
| 2H | a | a | a | a | a |
| 2I | a | a | a | a | a |
| 2J | a | a | a | a | a |
| 2K | a | a | a | a | a |
| 2L | a | a | a | a | a |

a: Good image without image smearing
b: Image in such a practically acceptable level that lines in the density of 7 lines/mm are not seen but lines in the density of 6 lines/mm are seen
c: Image having image smearing in such a level that lines in the density of 5 lines/mm are not seen

TABLE 45

| Production Conditions for Surface Layers in Comparative Example 7 | |
|---|---|
| $C_2F_6/H_2$ | 40 sccm/5 sccm |
| Inner Pressure (2G') | 2.7 Pa |
| Inner Pressure (2H') | 13.3 Pa |
| Inner Pressure (2I') | 20.0 Pa |
| Temperature | 200° C. |
| Power | 400 W (105 MHz) |

TABLE 46

| Light Receiving Member | Wear Loss (Å/10,000 sheets) | Fluorine Content (%) | Dynamic Hardness (kgf/mm$^2$) |
|---|---|---|---|
| 2G' | 120 | 53 | 9 |
| 2H' | 150 | 60 | 7 |
| 2I' | 180 | 70 | 4 |

TABLE 47

| Light Receiving Member | Uneven Scraping | Fusion | Cleaning Failure |
|---|---|---|---|
| 2G' | c | a | c |
| 2H' | c | a | c |
| 2I' | c | a | c |
| 2J' | b | a | c |
| 2K' | b | a | c |
| 2L' | b | a | c |

TABLE 48

| Light Receiving Member | 10,000 sheets | 30,000 sheets | 50,000 sheets | 80,000 sheets | 100,000 sheets |
|---|---|---|---|---|---|
| 2G' | a | a | a | a | a |
| 2H' | a | a | a | a | a |
| 2I' | a | a | a | a | a |
| 2J' | a | a | b | b | c |
| 2K' | a | a | a | b | b |
| 2L' | a | a | a | a | b |

a: Good image without image smearing
b: Image in such a practically acceptable level that lines in the density of 7 lines/mm are not seen but lines in the density of 6 lines/mm are seen
c: Image having image smearing in such a level that lines in the density of 5 lines/mm are not seen

TABLE 49

Production Conditions for Surface Layers in Example 10

| $C_2F_6/H_2$ | 120 sccm/120 sccm |
|---|---|
| Inner Pressure (2J) | 13.3 Pa |
| Inner Pressure (2K) | 20.0 Pa |
| Inner Pressure (2L) | 26.6 Pa |
| Temperature | 100° C. |
| Power | 200 W (105 MHz) |

TABLE 50

| Light Receiving Member | Wear Loss (Å/10,000 sheets) | Fluorine Content (%) | Dynamic Hardness (kgf/mm$^2$) |
|---|---|---|---|
| 2J | 5 | 10 | 450 |
| 2K | 20 | 23 | 300 |
| 2L | 30 | 35 | 160 |

TABLE 51

Production Conditions for Surface Layers in Comparative Example 8

| $SiH_4/CH_4$ | 50 sccm/50 sccm |
|---|---|
| Power (2J') | 1000 W (105 MHz) |
| Power (2K') | 800 W (105 MHz) |
| Power (2L') | 500 W (105 MHz) |
| Temperature | 200° C. |
| Inner Pressure | 2.7 Pa |

TABLE 52

| Light Receiving Member | Wear Loss (Å/10,000 sheets) | Fluorine Content (%) | Dynamic Hardness (kgf/mm$^2$) |
|---|---|---|---|
| 2J' | 0.01 | 0.3 | 900 |
| 2K' | 0.04 | 2.0 | 750 |
| 2L' | 0.08 | 3.0 | 600 |

What is claimed is:

1. An electrophotographic apparatus in which a light receiving member is rotated and the steps of charging, exposure, developing, transfer and cleaning are successively repeated and in which a developer of an average particle diameter of 5 to 8 $\mu$m is applied for developing onto a surface of the light receiving member and transferred from the light receiving member surface to a transfer medium and the light receiving member surface after the transfer of the developer is scrape-cleaned with an elastic rubber blade having the modulus of repulsion elasticity of not less than 10% nor more than 50%, wherein the light receiving member has a surface layer comprised of a non-monocrystalline fluorinated carbon film in which the wear loss after copying steps of 10,000 A4-size transfer sheets is not less than 0.1 Å nor more than 100 Å.

2. The electrophotographic apparatus according to claim 1, wherein the light receiving member comprises a photoconductive layer comprised of a non-monocrystalline material comprising silicon atoms as a main constituent on a conductive substrate.

3. The electrophotographic apparatus according to claim 1, wherein the surface layer has a dynamic hardness of 10 to 500 kgf/mm$^2$.

4. The electrophotographic apparatus according to claim 1, wherein the fluorine content (F/(C+F)) of the non-monocrystalline fluorinated carbon film is 5 to 50 atomic %.

5. The electrophotographic apparatus according to claim 1, wherein the surface layer is a deposited film formed by decomposing at least a hydrocarbon gas and/or a fluorine-containing gas by the plasma CVD using a high frequency of 1 to 450 MHz.

6. The electrophotographic apparatus according to claim 1, wherein the light receiving member comprises the three layers of a charge injection inhibiting layer, a photoconductive layer and a surface layer.

7. The electrophotographic apparatus according to claim 1, wherein the light receiving member comprises the three layers of a charge transport layer, a charge generating layer and a surface layer.

8. The electrophotographic apparatus according to claim 1, further comprising rubbing means for rubbing the light receiving member surface in any one of the steps.

9. The electrophotographic apparatus according to claim 8, wherein the rubbing means is a cleaning roller comprising a rubber roller or magnet roller provided in a section for carrying the cleaning step.

10. The electrophotographic apparatus according to claim 8, wherein the rubbing means is an expanded rubber roller provided in a section for carrying the cleaning step.

11. The electrophotographic apparatus according to claim 8, wherein the rubbing means is a member for effecting roller charging or roller transfer provided in a section for carrying the charging step.

12. The electrophotographic apparatus according to claim 8, wherein the light receiving member comprises a photoconductive layer comprised of a non-monocrystalline material comprising silicon atoms as a main constituent on a conductive substrate.

13. The electrophotographic apparatus according to claim 8, wherein the surface layer has a dynamic hardness of 10 to 500 kgf/mm$^2$.

14. The electrophotographic apparatus according to claim 8, wherein the fluorine content (F/(C+F)) of the non-monocrystalline fluorinated carbon film is 5 to 50 atomic %.

15. The electrophotographic apparatus according to claim 8, wherein the surface layer is a deposited film formed by decomposing at least a hydrocarbon gas and/or a fluorine-containing gas by the plasma CVD using a high frequency of 1 to 450 MHz.

16. The electrophotographic apparatus according to claim 8, wherein the light receiving member comprises the three layers of a charge injection inhibiting layer, a photoconductive layer and a surface layer.

17. The electrophotographic apparatus according to claim 8, wherein the light receiving member comprises the three layers of a charge transport layer, a charge generating layer and a surface layer.

18. A light receiving member for an electrophotographic apparatus in which the light receiving member is rotated and the steps of charging, exposure, developing, transfer and cleaning are successively repeated and in which a developer of an average particle diameter of 5 to 8 $\mu$m is applied for developing onto a surface of the light receiving member and transferred from the light receiving member surface to a transfer medium and the light receiving member surface after the transfer of the developer is scrape-cleaned with an elastic rubber blade having the modulus of repulsion elasticity of not less than 10% nor more than 50%, wherein the light receiving member has a surface layer comprised of a non-monocrystalline fluorinated carbon film in which the wear loss after copying steps of 10,000 A4-size transfer sheets is not less than 0.1 Å nor more than 100 Å.

19. The light receiving member according to claim 18, which comprises a photoconductive layer comprised of a non-monocrystalline material comprising silicon atoms as a main constituent on a conductive substrate.

20. The light receiving member according to claim 18, wherein the surface layer has a dynamic hardness of 10 to 500 kgf/mm$^2$.

21. The light receiving member according to claim 18, wherein the fluorine content (F/(C+F)) of the non-monocrystalline fluorinated carbon film is 5 to 50 atomic %.

22. The light receiving member according to claim 18, wherein the surface layer is a deposited film formed by decomposing at least a hydrocarbon gas and/or a fluorine-containing gas by the plasma CVD using a high frequency of 1 to 450 MHz.

23. The light receiving member according to claim 18, which comprises the three layers of a charge injection inhibiting layer, a photoconductive layer and a surface layer.

24. The light receiving member according to claim 18, which comprises the three layers of a charge transport layer, a charge generating layer and a surface layer.

25. The light receiving member according to claim 18, further comprising rubbing means for rubbing the light receiving member surface in any one of the steps.

26. The light receiving member according to claim 25, wherein the rubbing means is a cleaning roller comprising a rubber roller or magnet roller provided in a section for carrying the cleaning step.

27. The light receiving member according to claim 25, wherein the rubbing means is an expanded rubber roller provided in a section for carrying the cleaning step.

28. The light receiving member according to claim 25 wherein the rubbing means is a member for effecting roller charging or roller transfer provided in a section for carrying the charging step.

29. The light receiving member according to claim 25, which comprises a photoconductive layer comprised of a non-monocrystalline material comprising silicon atoms as a main constituent on a conductive substrate.

30. The light receiving member according to claim 25, wherein the surface layer has a dynamic hardness of 10 to 500 kgf/mm$^2$.

31. The light receiving member according to claim 25, wherein the fluorine content (F/(C+F)) of the non-monocrystalline fluorinated carbon film is 5 to 50 atomic %.

32. The light receiving member according to claim 25, wherein the surface layer is a deposited film formed by decomposing at least a hydrocarbon gas and/or a fluorine-containing gas by the plasma CVD using a high frequency of 1 to 450 MHz.

33. The light receiving member according to claim 25, which comprises the three layers of a charge injection inhibiting layer, a photoconductive layer and a surface layer.

34. The light receiving member according to claim 25, which comprises the three layers of a charge transport layer, a charge generating layer and a surface layer.

* * * * *